US008006378B2

(12) United States Patent
Kokubun et al.

(10) Patent No.: US 8,006,378 B2
(45) Date of Patent: Aug. 30, 2011

(54) METHOD AND SYSTEM FOR COMPONENT POSITIONING DURING ASSEMBLY OF SCROLL-TYPE FLUID MACHINE

(75) Inventors: Shinobu Kokubun, Tokyo (JP); Toshiaki Iwasaki, Tokyo (JP); Tomohiro Shirahata, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 1434 days.

(21) Appl. No.: 11/492,833

(22) Filed: Jul. 26, 2006

(65) Prior Publication Data

US 2007/0033801 A1 Feb. 15, 2007

(30) Foreign Application Priority Data

Aug. 11, 2005 (JP) ..... 2005-233003

(51) Int. Cl.
*B23P 15/00* (2006.01)
*B23P 11/00* (2006.01)
*B23P 21/00* (2006.01)
*B23Q 15/00* (2006.01)

(52) U.S. Cl. ..... 29/888.022; 29/434; 29/709; 29/712

(58) Field of Classification Search ..... 29/888.022, 29/434, 709, 712; 700/95, 96, 97, 108, 112, 700/114
See application file for complete search history.

(56) References Cited

U.S. PATENT DOCUMENTS 4,365,941 A * 12/1982 Tojo et al. ..... 417/372
4,706,353 A * 11/1987 Zgliczynski et al. .... 29/888.025
5,042,150 A * 8/1991 Fraser, Jr. ..... 29/888.022
5,055,012 A * 10/1991 Sakashita et al. ..... 417/440
5,071,323 A * 12/1991 Sakashita et al. ..... 417/440
5,186,616 A * 2/1993 Hirano ..... 418/55.5
5,328,340 A * 7/1994 Hara et al. ..... 418/55.1
5,330,463 A * 7/1994 Hirano ..... 418/55.5
5,382,143 A * 1/1995 Nakamura et al. ..... 418/55.1
5,549,466 A * 8/1996 Hori et al. ..... 418/55.1
5,557,845 A * 9/1996 Burkett et al. ..... 29/888.022
5,564,186 A * 10/1996 Hori et al. ..... 29/888.022
5,597,296 A * 1/1997 Akazawa et al. ..... 418/55.1
5,661,894 A * 9/1997 Kawasaki et al. ..... 29/596
5,842,271 A * 12/1998 Kawasaki et al. ..... 29/732

(Continued)

FOREIGN PATENT DOCUMENTS

JP 11-182457 A 7/1999

(Continued)

*Primary Examiner* — A Dexter Tugbang
*Assistant Examiner* — David Angwin
(74) *Attorney, Agent, or Firm* — Buchanan Ingersoll & Rooney PC

(57) ABSTRACT

A positioning system used in assembling a scroll-type fluid machine includes a radial thrust mechanism driving motor for turning a radial thrust mechanism in synchronism with rotational phase of a rotary shaft, a vertical pressing mechanism for producing a vertical pressing force for pressing a stationary scroll against a frame, a displacement sensor for measuring horizontal displacements of a stationary scroll retaining mechanism from at least two directions, a first processor for calculating an orbital path of the stationary scroll from obtained measurement values, a second processor for evaluating stability of the orbital path of the stationary scroll based on vertical pressing force data and the orbital path of the stationary scroll, and a third processor for calculating a fixing point on which the stationary scroll is to be fixedly centered with respect to the frame when the orbital path of the stationary scroll is judged to be stable.

5 Claims, 16 Drawing Sheets

U.S. PATENT DOCUMENTS

| | | | | |
|---|---|---|---|---|
| 5,951,272 | A * | 9/1999 | Fukuhara et al. | 418/55.4 |
| 6,113,373 | A * | 9/2000 | Fukuhara et al. | 418/55.4 |
| 6,158,989 | A * | 12/2000 | Barito | 418/55.1 |
| 6,241,495 | B1 * | 6/2001 | Chang | 418/55.5 |
| 6,264,443 | B1 * | 7/2001 | Barito | 418/1 |
| 6,280,155 | B1 * | 8/2001 | Dreiman | 417/410.5 |
| 6,488,489 | B2 * | 12/2002 | Williams et al. | 418/55.1 |
| 6,499,977 | B2 * | 12/2002 | Barito et al. | 418/55.1 |
| 6,616,429 | B1 * | 9/2003 | Weber et al. | 418/55.1 |
| 7,419,370 | B2 * | 9/2008 | Masuda | 418/55.5 |
| 7,491,045 | B2 * | 2/2009 | Masuda | 418/55.5 |
| 7,841,845 | B2 * | 11/2010 | Ignatiev | 418/55.1 |
| 2002/0062560 | A1 * | 5/2002 | Takeda et al. | 29/888.022 |

FOREIGN PATENT DOCUMENTS

| | | | | |
|---|---|---|---|---|
| JP | 11-270473 | A | | 10/1999 |
| JP | 2001-221170 | | * | 8/2001 |
| JP | 2001-221170 | A | | 8/2001 |
| JP | 3287573 | | * | 6/2002 |
| JP | 3287573 | B2 | | 6/2002 |
| JP | 2003-184761 | A | | 7/2003 |
| WO | 95/12759 | A1 | | 5/1995 |

* cited by examiner

A1-A1 cross section

A2-A2 cross section

A1-A1 cross section

A2-A2 cross section

METHOD AND SYSTEM FOR COMPONENT POSITIONING DURING ASSEMBLY OF SCROLL-TYPE FLUID MACHINE

BACKGROUND OF THE INVENTION

1. Field of the Invention

The present invention relates to a method and a system for component positioning used during assembly of a scroll-type fluid machine which is incorporated in such an apparatus as a refrigerator, an air conditioner or a vacuum pump. More particularly, the invention is concerned with a method and a system for positioning a stationary scroll when fixing the same to a frame in combination with an orbiting scroll.

2. Description of the Background Art

Conventionally, a process of assembling a scroll-type fluid machine requires a step of centering a stationary scroll. For example, a process of assembling a scroll-type fluid machine includes the steps of assembling a compliant frame in a guide frame, inserting a rotary shaft into a rotary shaft bearing formed in the compliant frame, engaging an Oldham coupling with Oldham guide grooves formed in the compliant frame, and assembling an orbiting scroll with the compliant frame with the Oldham coupling placed in between such that an eccentric shaft end portion formed at one end of the rotary shaft is fitted in an eccentric shaft end bearing formed in the orbiting scroll. Subsequently, a stationary scroll is assembled with the orbiting scroll and fixed in position by tightening bolts. In this assembling process, the stationary scroll is positioned with respect to the guide frame by fitting reamer pins in reamed holes formed in both the guide frame and the stationary scroll. Japanese Patent No. 3287573 describes an example of this kind of stationary scroll positioning method using reamer pins and an assembly method for assembling a scroll-type fluid machine.

On the other hand, Japanese Patent Application Publication No. 2001-221170 describes another kind of stationary scroll positioning method which does not require any reamer pins. According to this Publication, the stationary scroll positioning method is used in a process of assembling a scroll-type fluid machine from a semifinished assembly which has been prepared by assembling an orbiting scroll having a spiral-shaped wall, or scroll wrap, and a rotary shaft for turning the orbiting scroll in a frame in such a manner that the orbiting scroll can produce orbital motion and the rotary shaft is supported from a radial direction, and arranging a stationary scroll having a spiral-shaped scroll wrap in such a manner that the scroll wraps of the stationary scroll and the orbiting scroll are intermeshed and the stationary scroll can move relative to the frame. This stationary scroll positioning method includes the steps of:

(a) holding the frame of the aforementioned semifinished assembly;

(b) turning the rotary shaft while applying a horizontal thrust such that the rotary shaft inclines;

(c) pressing the stationary scroll against the frame under specific pressure while the rotary shaft turns;

(d) measuring displacements of the stationary scroll in individual horizontal directions from at least two directions when the rotary shaft turns;

(e) evaluating stability of an orbital path of the stationary scroll based on the displacements of the stationary scroll in the individual horizontal directions measured in step (d) above; and (f) determining a fixing point on which the stationary scroll is to be fixedly centered with respect to the frame if the orbital path of the stationary scroll is judged to be stable in step (e) above based on the displacements measured in step (d) above.

Generally, in a scroll-type fluid machine used as a compressor, a stationary scroll and an orbiting scroll must be arranged with high precision in accordance with a prescribed geometrical arrangement scheme such that a smoothly changing clearance is created between scroll wraps of the two scrolls, thus forming a series of pockets (compression chambers) from one contact point of the scroll wraps to the next. If the stationary and orbiting scrolls are not intermeshed with such high precision, it will be impossible to achieve high performance and reliability of the compressor due to poor fluid tightness of the compression chambers.

It is usually impossible to create such a smoothly changing clearance between the scroll wraps of the stationary and orbiting scrolls by using the conventional positioning method and assembly method described in Japanese Patent No. 3287573 as a result of dimensional errors occurring in machining the scroll wraps or poor accuracy of machining central parts of the scroll wraps and the reamed holes. Additionally, machining cost necessary for making the reamed holes and materials cost needed for the reamer pins would lead to an overall cost increase.

While the stationary scroll positioning method of Japanese Patent Application Publication No. 2001-221170 is intended to solve the aforementioned problems discussed with reference to the stationary scroll positioning method of Japanese Patent No. 3287573 using the reamer pins, the positioning method of the former Publication has disadvantage which are described below. In the semifinished assembly prepared in the process of assembling the scroll-type fluid machine of Japanese Patent Application Publication No. 2001-221170, both the frame (which may include not only a guide frame but also a compliant frame if provided) in which a rotary shaft bearing is formed and a sub-frame in which a secondary shaft end bearing is formed are fixed in an outer cylinder (or shell having a cylindrical shape) of the scroll-type fluid machine in advance. Therefore, in this semifinished assembly in which the stationary scroll is meshed with the orbiting scroll which is placed on top of the frame with an Oldham ring sandwiched in between, it may occasionally be impossible to sufficiently incline the rotary shaft with respect to the rotary shaft bearing and the secondary shaft end bearing in a reliable fashion in step (b) above. For this reason, the fixing point obtained in step (f) of the positioning method of Japanese Patent Application Publication No. 2001-221170 may not a correct fixing point where the stationary scroll should be fixed for forming a series of pockets between the scroll wraps of the stationary scroll and the orbiting scroll.

SUMMARY OF THE INVENTION

The invention is intended to overcome the aforementioned problems of the prior art. Accordingly, it is an object of the invention to provide a method and a system for component positioning used during assembly of a scroll-type fluid machine as well as a method and a system for assembling a scroll-type fluid machine, whereby a stationary scroll can be automatically positioned with high precision from a condition in which a scroll wrap of the stationary scroll and a scroll wrap of an orbiting scroll are intermeshed regardless of accuracy of machining the scroll wraps of the stationary and orbiting scrolls and regardless of whether a frame in which a rotary shaft bearing is formed and a sub-frame in which a secondary shaft end bearing is formed are fixed in a shell of the scroll-type fluid machine in advance.

In one aspect of the invention, a positioning method is used in a process of assembling a scroll-type fluid machine from a semifinished assembly which has been prepared by fixing a frame in a shell, inserting a rotary shaft into a rotary shaft bearing formed in the frame, inserting a secondary shaft end portion of the rotary shaft into a secondary shaft end bearing formed in a sub-frame, fixing the sub-frame in the shell, assembling an orbiting scroll with the frame with an Oldham coupling placed in between such that an eccentric shaft end portion formed at one end of the rotary shaft is fitted in an eccentric shaft end bearing formed in the orbiting scroll, assembling a stationary scroll with the orbiting scroll such that a scroll wrap of the stationary scroll meshes with a scroll wrap of the orbiting scroll, and tentatively fixing the stationary scroll to the frame in such a manner that the stationary scroll is allowed to move freely relative to the frame.

The positioning method includes the steps of:

(a) holding the shell of the aforementioned semifinished assembly;

(b) holding the stationary scroll in such a manner that the stationary scroll can move both horizontally and vertically;

(c) exerting a horizontal thrust on the stationary scroll, thereby causing the rotary shaft to incline in a direction opposite to a direction in which the eccentric shaft end portion of the rotary shaft is oriented;

(d) turning the rotary shaft while varying rotational phase of the horizontal thrust exerted on the stationary scroll in synchronism with rotational phase of the rotary shaft;

(e) determining an orbital path of the stationary scroll by measuring displacements thereof;

(f) incrementally pressing the stationary scroll against the frame;

(g) evaluating stability of the orbital path of the stationary scroll determined in step (e) above based on measurement values of the displacements of the stationary scroll in each successive pressing stage of step (f) above; and (h) determining a fixing point on which the stationary scroll is to be fixedly centered with respect to the frame if the orbital path of the stationary scroll is judged to be stable.

In another aspect of the invention, a positioning method is used in a process of assembling a scroll-type fluid machine from a semifinished assembly which has been prepared by inserting a rotary shaft into a rotary shaft bearing formed in a frame, assembling an orbiting scroll with the frame with an Oldham coupling placed in between such that an eccentric shaft end portion formed at one end of the rotary shaft is fitted in an eccentric shaft end bearing formed in the orbiting scroll, assembling a stationary scroll with the orbiting scroll such that a scroll wrap of the stationary scroll meshes with a scroll wrap of the orbiting scroll, and tentatively fixing the stationary scroll to the frame in such a manner that the stationary scroll is allowed to move freely relative to the frame.

The positioning method includes the steps of:

(a) holding the frame of the aforementioned semifinished assembly;

(b) holding the stationary scroll in such a manner that the stationary scroll can move both horizontally and vertically;

(c) exerting a horizontal thrust on the stationary scroll, thereby causing the rotary shaft to incline in a direction opposite to a direction in which the eccentric shaft end portion of the rotary shaft is oriented;

(d) turning the rotary shaft while varying rotational phase of the horizontal thrust exerted on the stationary scroll in synchronism with rotational phase of the rotary shaft;

(e) determining an orbital path of the stationary scroll by measuring displacements thereof;

(f) incrementally pressing the stationary scroll against the frame;

(g) evaluating stability of the orbital path of the stationary scroll determined in step (e) above based on measurement values of the displacements of the stationary scroll in each successive pressing stage of step (f) above; and (h) determining a fixing point on which the stationary scroll is to be fixedly centered with respect to the frame if the orbital path of the stationary scroll is judged to be stable.

In another aspect of the invention, a positioning system is used in a process of assembling a scroll-type fluid machine from a semifinished assembly which has been prepared by fixing a frame in a shell, inserting a rotary shaft into a rotary shaft bearing formed in the frame, inserting a secondary shaft end portion of the rotary, shaft into a secondary shaft end bearing formed in a sub-frame, fixing the sub-frame in the shell, assembling an orbiting scroll with the frame with an Oldham coupling placed in between such that an eccentric shaft end portion formed at one end of the rotary shaft is fitted in an eccentric shaft end bearing formed in the orbiting scroll, assembling a stationary scroll with the orbiting scroll such that a scroll wrap of the stationary scroll meshes with a scroll wrap of the orbiting scroll, and tentatively fixing the stationary scroll to the frame in such a manner that the stationary scroll is allowed to move freely relative to the frame.

The positioning system includes a work retaining mechanism for holding the shell of the aforementioned semifinished assembly, a stationary scroll retaining mechanism for holding the stationary scroll in such a manner that the stationary scroll can move both horizontally and vertically, a rotary shaft driving motor for turning the rotary shaft, a radial thrust mechanism for exerting a horizontal thrust on the stationary scroll retaining mechanism, a radial thrust mechanism driving motor for turning the radial thrust mechanism in synchronism with rotational phase of the rotary shaft, a vertical pressing mechanism for producing a vertical pressing force for pressing the stationary scroll against the frame, a displacement sensor for measuring horizontal displacements of the stationary scroll retaining mechanism from at least two directions, a first processor for calculating an orbital path of the stationary scroll from measurement values obtained by the displacement sensor, a second processor for evaluating stability of the orbital path of the stationary scroll based on data on the vertical pressing force and the orbital path of the stationary scroll, and a third processor for calculating a fixing point on which the stationary scroll is to be fixedly centered with respect to the frame when the orbital path of the stationary scroll is judged to be stable.

In still another aspect of the invention, a positioning system is used in a process of assembling a scroll-type fluid machine from a semifinished assembly which has been prepared by inserting a rotary shaft into a rotary shaft bearing formed in a frame, assembling an orbiting scroll with the frame with an Oldham coupling placed in between such that an eccentric shaft end portion formed at one end of the rotary shaft is fitted in an eccentric shaft end bearing formed in the orbiting scroll, assembling a stationary scroll with the orbiting scroll such that a scroll wrap of the stationary scroll meshes with a scroll wrap of the orbiting scroll, and tentatively fixing the stationary scroll to the frame in such a manner that the stationary scroll is allowed to move freely relative to the frame.

The positioning system includes a work retaining mechanism for holding the frame, a stationary scroll retaining mechanism for holding the stationary scroll in such a manner that the stationary scroll can move both horizontally and vertically, a rotary shaft driving motor for turning the rotary shaft, a radial thrust mechanism for exerting a horizontal thrust on the stationary scroll retaining mechanism, a radial thrust mechanism driving motor for turning the radial thrust mechanism in synchronism with rotational phase of the rotary shaft, a vertical pressing mechanism for producing a vertical pressing force for pressing the stationary scroll against the frame, a displacement sensor for measuring horizontal displacements of the stationary scroll retaining mechanism from at least two directions, a first processor for calculating an orbital path of the stationary scroll from measurement values obtained by the displacement sensor, a second processor for evaluating stability of the orbital path of the stationary scroll based on data on the vertical pressing force and the orbital path of the stationary scroll, and a third processor for calculating a fixing point on which the stationary scroll is to be fixedly centered with respect to the frame when the orbital path of the stationary scroll is judged to be stable.

According to the present invention, it is possible to automatically position the stationary scroll with high precision from a condition in which scroll wraps of the stationary scroll and an orbiting scroll are intermeshed regardless of machining accuracy the scroll wraps of the two scrolls and other elements of a scroll-type fluid machine.

These and other objects, features and advantages of the invention will become more apparent upon a reading of the following detailed description in conjunction with the accompanying drawings.

DESCRIPTION OF THE PREFERRED EMBODIMENTS

The invention is now described in detail with reference to preferred embodiments which are illustrated in the accompanying drawings.

First Embodiment

Figure 1:
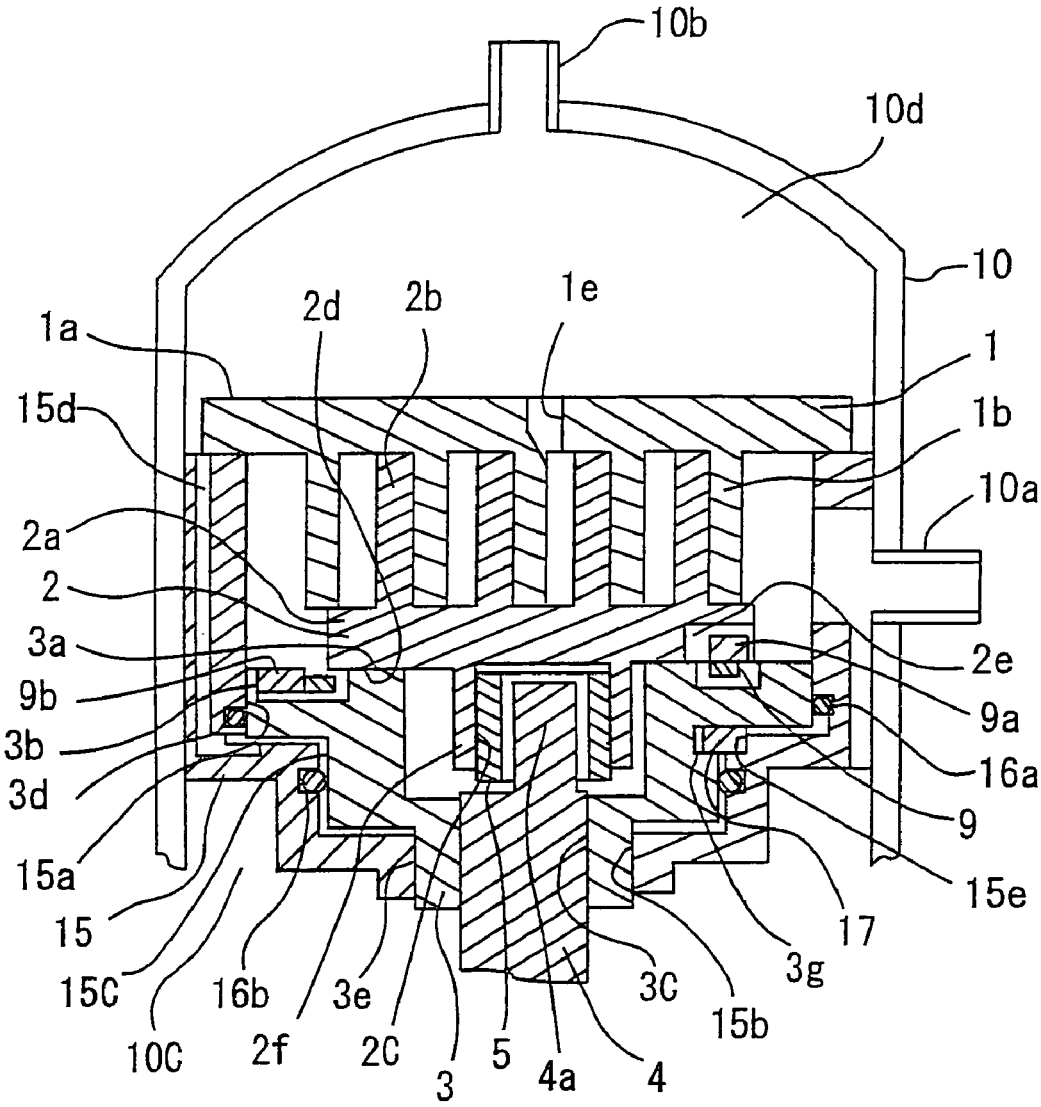
FIG. 1 is a fragmentary cross-sectional view of a scroll-type fluid machine to which the invention is applied.

FIG. 1 is a fragmentary cross-sectional view of a scroll-type fluid machine to which the invention is applied. As shown in FIG. 1, the scroll-type fluid machine includes a stationary scroll 1 and an orbiting scroll 2. The stationary scroll 1 includes an end plate la and a spiral wall, or scroll wrap lb, formed on one side (bottom side as illustrated) of the end plate la. The end plate la of the stationary scroll 1 is fixed to a guide frame 15 at outer peripheral parts by bolt joints (not shown).

The orbiting scroll 2 includes an end plate 2*a* and a scroll wrap 2*b* formed on one side (top side as illustrated) of the end plate 2*a*, the scroll wrap 2*b* having substantially the same shape as the scroll wrap 1*b* of the stationary scroll 1. The orbiting scroll 2 also includes a hollow cylindrical boss 2*f* formed at a central part of a side (bottom side as illustrated) of the end plate 2*a* opposite the side on which the scroll wrap 2*b* is formed. There is formed an eccentric shaft end bearing 2*c* on an inside wall surface of the boss 2*f* of the orbiting scroll 2. Further, there is formed a thrust surface 2*d* on the same side of the end plate 2*a* as the boss 2*f* is formed near the outer periphery of the end plate 2*a*. The thrust surface 2*d* of the orbiting scroll 2 is a finished surface which can slide over a thrust bearing 3*a* of a compliant frame 3 in direct contact therewith under pressure.

A pair of generally straight Oldham guide grooves 2*e* is formed in outer peripheral parts of the end plate 2*a* of the orbiting scroll 2. A pair of orbiting scroll-side claws 9*a* formed on an Oldham ring 9 meshes with the Oldham guide grooves 2*e* formed in the orbiting scroll 2 so that the orbiting scroll-side claws 9*a* can slide back and forth along the Oldham guide grooves 2*e* in a radial direction. On the other hand, a pair of generally straight Oldham guide grooves 3*b* is formed in the compliant frame 3 with a phase difference of approximately 90 degrees with respect to the Oldham guide grooves 2*e* formed in the orbiting scroll 2. A pair of frame-side claws 9*b* formed on the Oldham ring 9 meshes with the Oldham guide grooves 3*b* formed in the compliant frame 3 so that the frame-side claws 9*b* can slide back and forth along the Oldham guide grooves 3*b* in a radial direction.

At a central part of the compliant frame 3, there is formed a rotary shaft bearing 3*c* for radially supporting a rotary shaft 4 which is driven by a motor. In the compliant frame 3, there is also formed a reamed hole 3*g* in which a reamer pin 17 is force-fitted. The reamer pin 17 engages a key groove 15*e* formed in the guide frame 15, whereby rotational phases of the compliant frame 3 and the guide frame 15 are controlled, that is, movement of the compliant frame 3 in a rotational direction relative to the guide frame 15 is restricted.

A curved outer surface of the guide frame 15 is fixed to a sealed casing 10 of which internal space is divided into a low-pressure chamber 10*c* and a high-pressure chamber 10*d*. On the inside of the guide frame 15, there are formed two cylindrical inner surfaces with controlled concentricity, that is, an upper intermeshing cylindrical surface 15*a* and a lower intermeshing cylindrical surface 15*b*. On the outside of the compliant frame 3, there are formed two cylindrical outer surfaces with controlled concentricity, that is, an upper intermeshing cylindrical surface 3*d* and a lower intermeshing cylindrical surface 3*e*. The upper intermeshing cylindrical surface 15*a* and the lower intermeshing cylindrical surface 15*b* of the guide frame 15 are fitted on the upper intermeshing cylindrical surface 3*d* and the lower intermeshing cylindrical surface 3*e* of the compliant frame 3, respectively. On the inside of the guide frame 15, there are formed sealing grooves at two locations, in which an upper sealing element 16*a* and a lower sealing element 16*b* are attached. The upper and lower sealing element 16*a*, 16*b* seal off part of a space formed between inside wall surfaces of the guide frame 15 and outside wall surfaces of the compliant frame 3, thereby creating a sealed space (high-pressure space) 15*c*. The sealed space 15*c* is connected to the high-pressure inlet hole 15*d* through a high-pressure inlet hole 15*d* formed in the guide frame 15.

At one end of the rotary shaft 4 directed toward the orbiting scroll 2, there is formed an eccentric shaft end portion 4*a* having a flat surface portion which is substantially parallel to an axial direction of the rotary shaft 4. The flat surface portion of the eccentric shaft end portion 4*a* is engaged with a flat surface portion formed on an inside wall surface of a slider 5 in such a fashion that the flat surface portions of the eccentric shaft end portion 4*a* and the slider 5 slide along each other in reciprocating motion. It is to be noted that the scroll-type fluid machine is not necessarily provided with the slider 5. The casing 10 has an inlet pipe 10*a* for introducing uncompressed low-pressure gas into the low-pressure chamber 10*c* and a delivery pipe 10*b* for discharging compressed high-pressure gas from the high-pressure chamber 10*d* to the exterior.

The working of the scroll-type fluid machine of FIG. 1 under steady-state running conditions is now described. Driving torque generated by the motor is transmitted to the slider 5 through the rotary shaft 4. This driving torque is transmitted to the orbiting scroll 2 through the eccentric shaft end bearing 2*c*. Since the Oldham ring 9 prohibits the orbiting scroll 2 from rotating on its own axis relative to both the stationary scroll 1 and the compliant frame 3, the driving torque fed from the motor causes the orbiting scroll 2 to produce orbital oscillating motion. The low-pressure gas introduced through the inlet pipe 10*a* and released into the low-pressure chamber 10*c* in the casing 10 is drawn into a pair of pockets (compression chambers) having a crescent shape in cross section formed between the spiral-shaped scroll wrap 1*b* of the stationary scroll 1 and the spiral-shaped scroll wrap 2*b* of the orbiting scroll 2 which are in mesh with each other. The gas is compressed as these compression chambers progressively decrease in size (volume) toward a central area of the two intermeshed scroll wraps 1*b*, 2*b* while maintaining substantially the same crescent shape. The compressed high-pressure gas thus produced is vented through a discharge port 1*e* formed in the end plate 1*a* of the stationary scroll 1 into the high-pressure chamber 10*d* in the casing 10 and finally discharged through the delivery pipe 10*b* of the casing 10 to the exterior.

Figure 2:
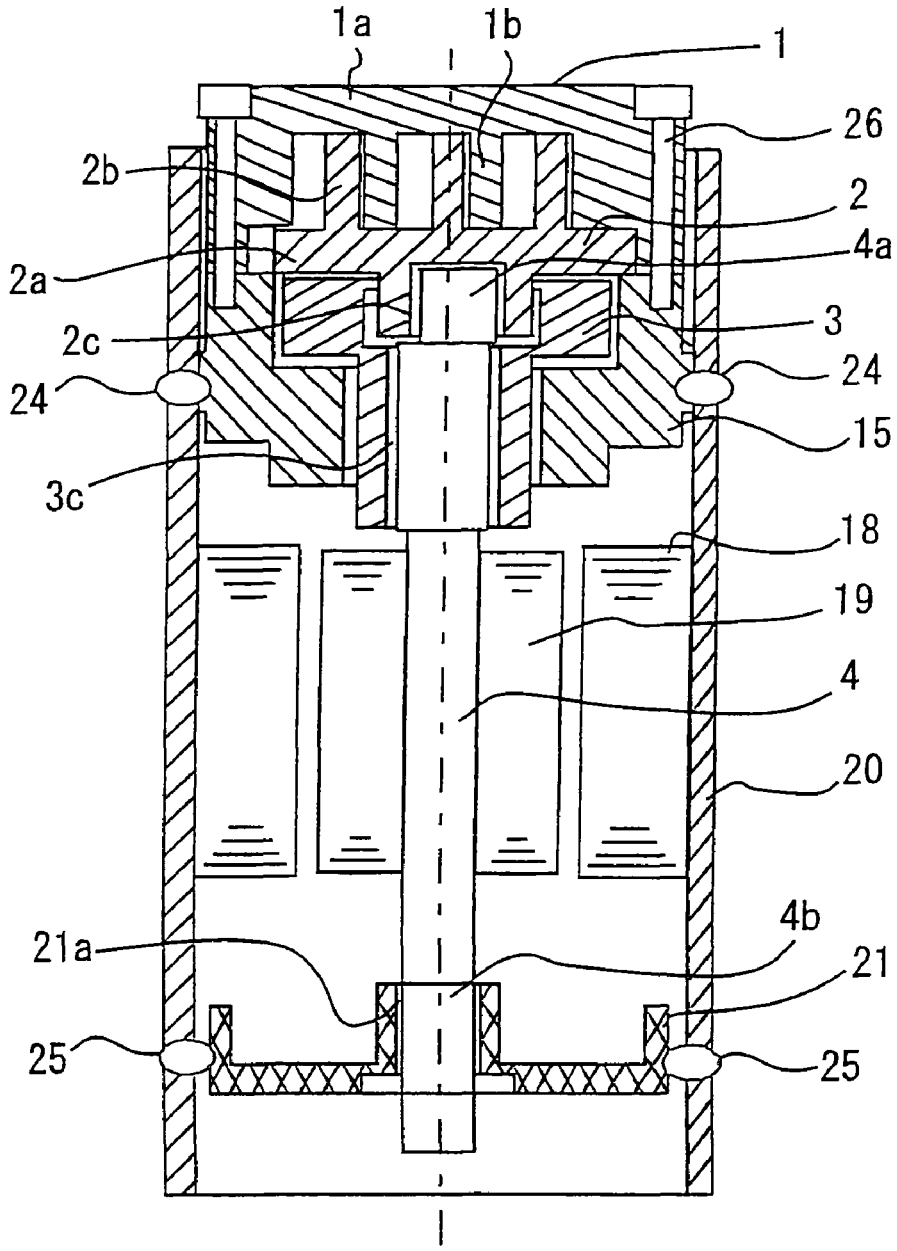
FIG. 2 is a cross-sectional side view of a semifinished scroll-type fluid machine which is a unit to be assembled by using a positioning method and a positioning system according to a first embodiment of the invention.

FIG. 2 is a cross-sectional side view of a semifinished scroll-type fluid machine which is a unit (or semifinished assembly) to be assembled by using a positioning method and a positioning system according to a first embodiment of the invention, in which a principal portion of the scroll-type fluid machine is installed inside an outer cylinder (or shell having a cylindrical shape) 20. In FIG. 2, elements identical to those shown in FIG. 1 are designated by the same reference numerals.

Referring to FIG. 2, the stationary scroll 1 has the spiral-shaped scroll wrap 1*b* formed on one side (bottom side as illustrated) of the end plate 1*a*, while the orbiting scroll 2 has the spiral-shaped scroll wrap 2*b* formed on one side (top side as illustrated) of the end plate 2*a*, the scroll wrap 2*b* having substantially the same shape as the scroll wrap 1*b* of the stationary scroll 1. The orbiting scroll 2 also has the hollow cylindrical boss 2*f* formed at the central part of the side (bottom side as illustrated) of the end plate 2*a* opposite the side on which the scroll wrap 2*b* is formed, with the eccentric shaft end bearing 2*c* formed on the inside wall surface of the boss 2*f*. At the central part of the compliant frame 3, there is formed the rotary shaft bearing 3*c* for radially supporting the rotary shaft 4 which is driven by the motor. The stationary scroll 1 is fixed to the guide frame 15 by a plurality of bolts 26. A stator 18 of the motor is fixed to an inner surface of the shell 20 of the scroll-type fluid machine. The stator 18 is positioned face to face with a rotor 19 of the motor which is fixedly mounted on an outer surface of the rotary shaft 4. A sub-frame 21 has a secondary shaft end bearing 21*a* in which a secondary shaft end portion 4*b* formed at a lower part of the outer surface of the rotary shaft 4 is fitted. The guide frame 15 and the sub-frame 21 are fixed to the inner surface of the shell 20 by welded joints 24 and 25, respectively. The Oldham ring 9 (Oldham coupling) is not shown in FIG. 2 for the sake of simplicity.

The positioning method and the positioning system used during assembly of the scroll-type fluid machine according to the first embodiment of the invention apply to a process of positioning the stationary scroll 1 and fixing the same to the guide frame 15 which has been fixed to the shell 20 as illustrated in FIG. 2.

Now, the construction of the positioning system used for component positioning during assembly of the scroll-type fluid machine according to the first embodiment is described with reference to FIGS. 3 to 8.

Figure 3:
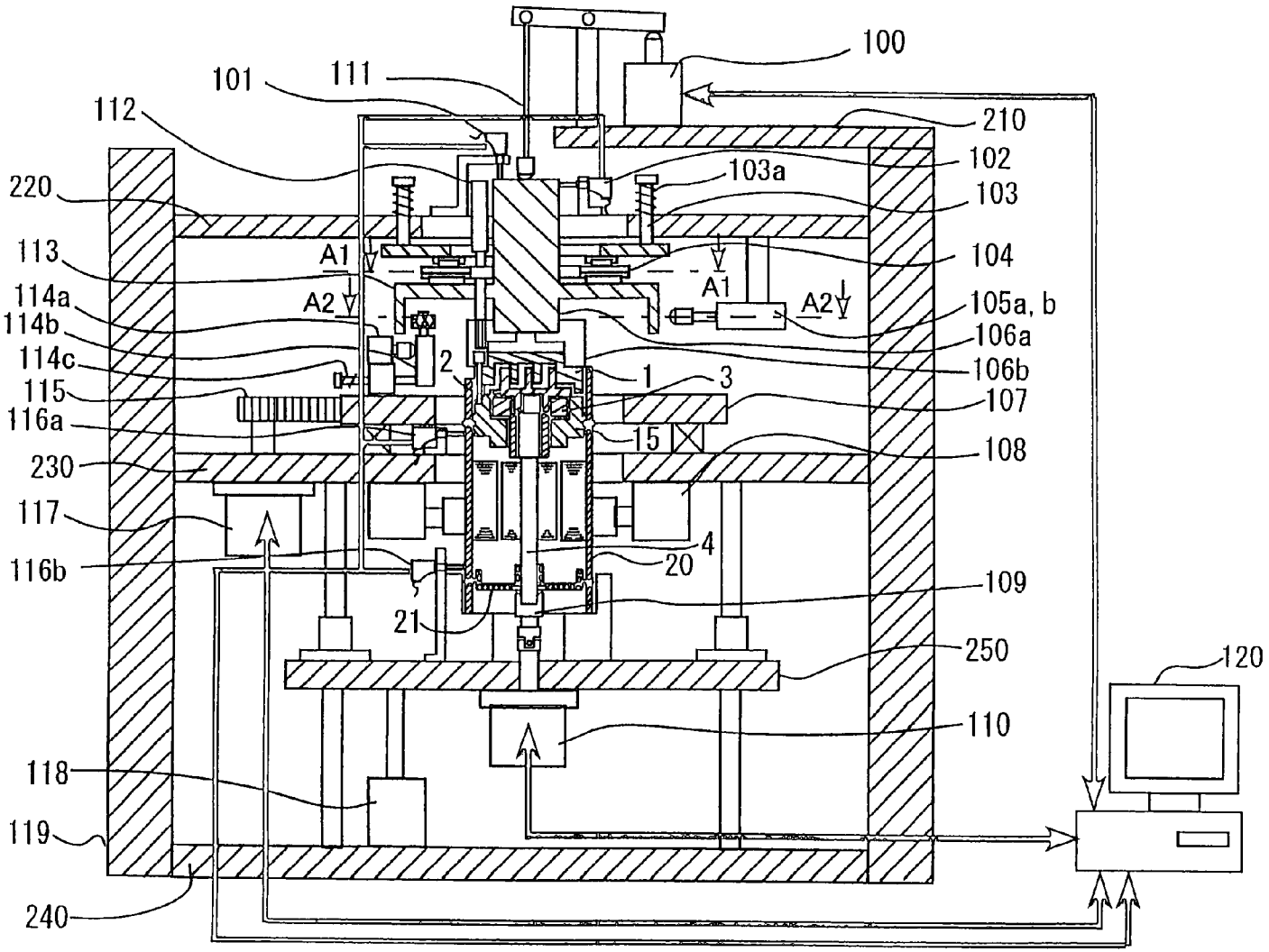
FIG. 3 is a diagram generally showing the construction of the positioning system used during assembly of the scroll-type fluid machine according to the first embodiment.

Referring to FIG. 3, the positioning system includes an assembly framework 119 to which a first platform 210, a second platform 220, a third platform 230 and a fourth platform 240 are attached, the first to fourth platforms 210-240 each having a horizontal reference surface. The third platform 230 is equipped with a work retaining mechanism 108 for holding the shell 20 of the scroll-type fluid machine at a fixed position in the positioning system. There is provided a vertically movable platform 250 between the third platform 230 and the fourth platform 240. The movable platform 250 which can be moved up and down by a cylinder 118 is provided with a rotary shaft driving motor 110 for turning the rotary shaft 4. On a drive shaft of the rotary shaft driving motor 110, there is provided a coupling 109 which serves as means for transmitting a torque produced by the rotary shaft driving motor 110 to the rotary shaft 4. The coupling 109 can be engaged with and disengaged from the rotary shaft 4 by vertically moving the movable platform 250 with the aid of the cylinder 118.

A stationary scroll retaining mechanism 106*b* shown in FIG. 3 is a mechanism for holding the stationary scroll 1. A measurement target 106*a* serves as a subject of measurements carried out by later-described displacement sensors 101 and 102. The measurement target 106*a* and the stationary scroll retaining mechanism 106*b* are rigid bodies joined to each other by bolts or the like (not shown).

A radial thrust mechanism 114*b* shown in FIG. 3 is a mechanism for pressing the scroll wrap 1*b* of the stationary scroll 1 in a radial direction against the scroll wrap 2*b* of the orbiting scroll 2 with the aid of a compression spring 114*c*. The radial thrust mechanism 114*b* is associated with a cylinder 114*a* incorporating a piston for canceling out a radial thrust produced by the radial thrust mechanism 114*b*.

A float block 113 shown in FIG. 3 is a rigid body on which the thrust produced by the radial thrust mechanism 114*b* is exerted. The float block 113, the measurement target 106*a* and the stationary scroll retaining mechanism 106*b* are joined to one another, together forming a single structure. Since the float block 113, the measurement target 106*a* and the stationary scroll retaining mechanism 106*b* are rigid bodies which are integrally assembled, it is possible to measure inclination and horizontal displacement of the stationary scroll 1 by measuring the measurement target 106*a* by the displacement sensors 101 and 102.

A suspension mechanism 103 is mounted on the second platform 220 of the assembly framework 119 to suspend the measurement target 106*a* and the stationary scroll retaining mechanism 106*b* joined into a single structure via suspension springs 103*a* in such a manner that the measurement target 106*a* and the stationary scroll retaining mechanism 106*b* can move in a vertical direction. An X-Y table 104 is mounted between the suspension mechanism 103 and the float block 113 to enable the float block 113, the measurement target 106*a* and the stationary scroll retaining mechanism 106*b* to move together in x- and y-directions in a horizontal plane (xy-plane).

Figure 5A:
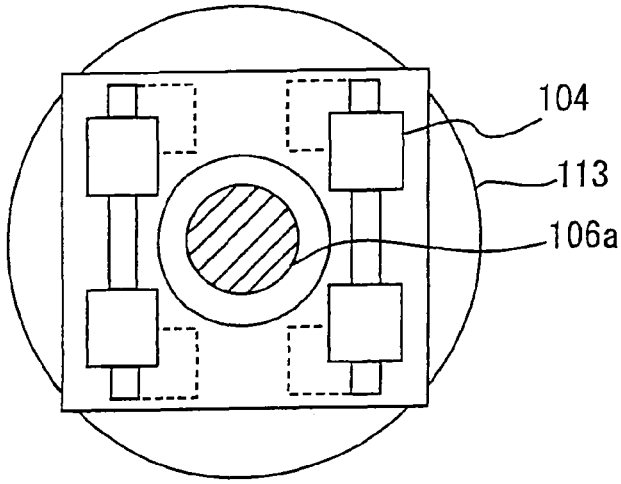
FIGS. 5A, 5B and 5C are diagrams showing how an X-Y table, a float block, a radial thrust mechanism and a stationary scroll retaining mechanism are situated under conditions where the radial thrust mechanism does not exert a thrust on the float block according to the first embodiment of the invention.
Figure 5B:
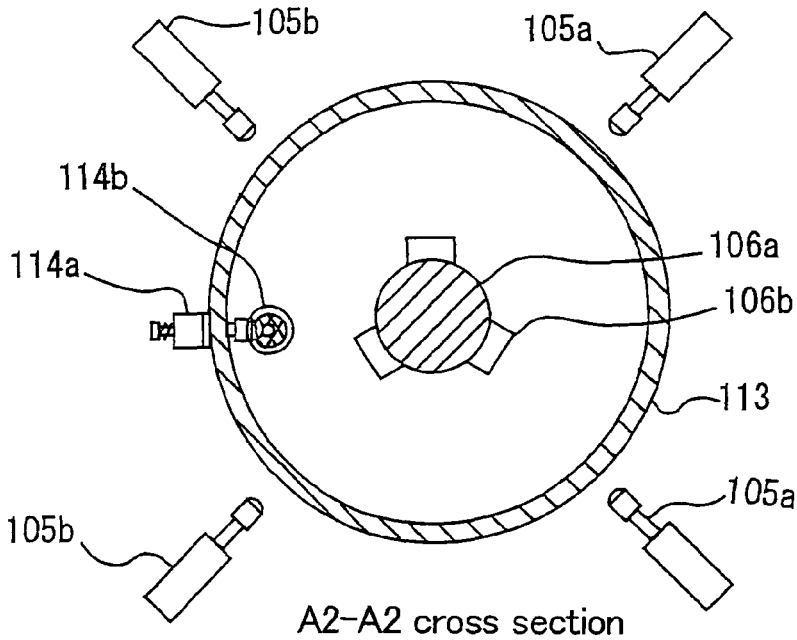
Figure 5C:
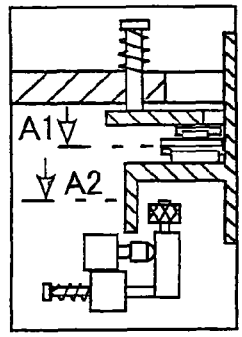
Figure 6A:
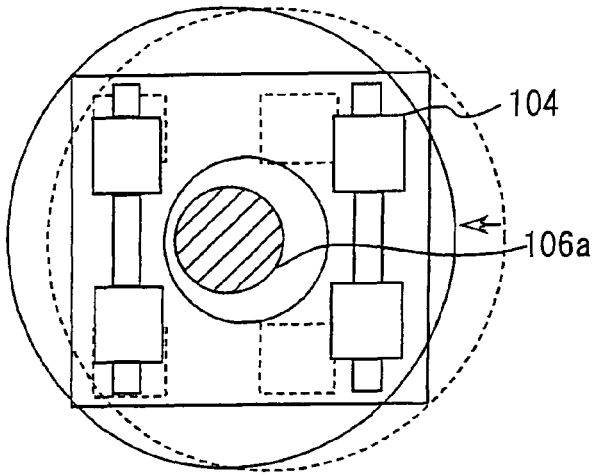
FIGS. 6A, 6B and 6C are diagrams showing how the X-Y table, the float block, the radial thrust mechanism and the stationary scroll retaining mechanism are situated under conditions where the radial thrust mechanism exerts a thrust on the float block according to the first embodiment of the invention.
Figure 6B:
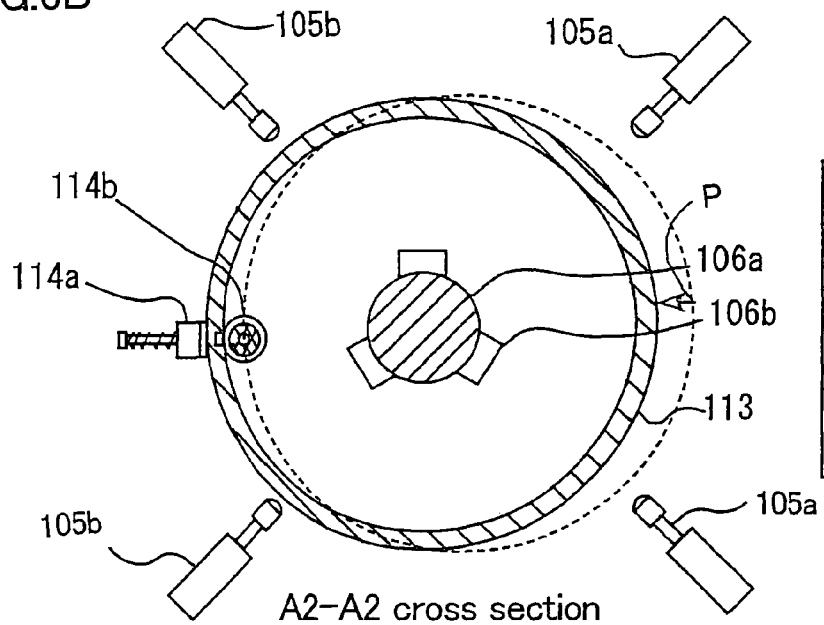
Figure 6C:
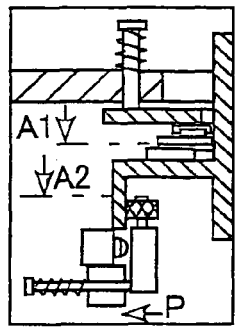

FIGS. 5A and 6A are fragmentary cross-sectional views taken by a plane shown by lines A1-A1 of FIG. 3, and FIGS. 5B and 6B are fragmentary cross-sectional views taken by a plane shown by lines A2-A2 of FIG. 3. FIGS. 5A, 5B and 5C show a condition in which the radial thrust mechanism 114*b* does not exert the thrust on the float block 113, whereas FIGS. 6A, 6B and 6C show a condition in which the radial thrust mechanism 114*b* exerts the thrust on the float block 113.

Referring to FIGS. 5A and 6A, the X-Y table 104 and the suspension mechanism 103 allow the float block 113 to move both horizontally and vertically relative to the assembly framework 119 without causing the float block 113 to rotate on its own axis.

The thrust produced by the radial thrust mechanism 114*b* and an elastic suspending force produced by the suspension springs 103*a* of the suspension mechanism 103 are preadjusted such that the radial thrust mechanism 114*b* and the suspension mechanism 103 together produce a combined force that is large enough to sufficiently incline the rotary shaft 4 relative to the rotary shaft bearing 3*c* and the secondary shaft end bearing 21*a*.

A radial thrust mechanism driving motor 117 shown in FIG. 3 is a motor for turning a rotary table 107 which is rotatably supported on the third platform 230 of the assembly framework 119 via a gear 115. Controlled to turn synchronously with the rotary shaft driving motor 110, the radial thrust mechanism driving motor 117 can vary the direction of the thrust produced by the radial thrust mechanism 114*b* which is fixed to the rotary table 107 in synchronism with the rotary shaft driving motor 110.

The aforementioned displacement sensors 101 are mounted on the second platform 220 of the assembly framework 119. The displacement sensors 101 determine vertical displacement of the stationary scroll retaining mechanism 106*b* holding the stationary scroll 1 by measuring vertical displacements of the measurement target 106*a* at different points thereof. It is possible to calculate inclination of the stationary scroll retaining mechanism 106*b* from these measurement values (vertical displacements of the measurement target 106*a*).

The aforementioned displacement sensors 102 are also mounted on the second platform 220 of the assembly framework 119. These displacement sensors 102 determine horizontal displacement of the stationary scroll retaining mechanism 106*b* holding the stationary scroll 1 by measuring horizontal displacements of the measurement target 106*a* at different points thereof.

Figure 4:
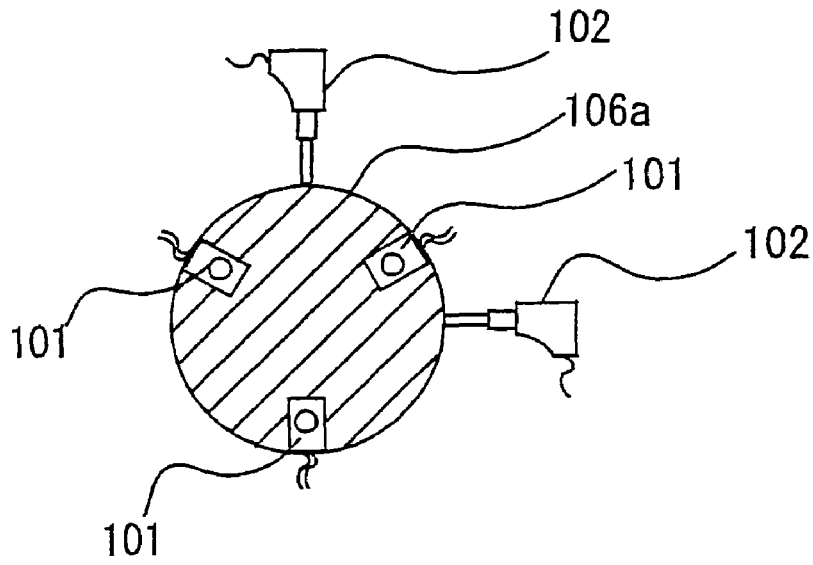
FIG. 4 is a plan view showing how displacement sensors are arranged with respect to a measurement target in the positioning system of the first embodiment of the invention.

The displacement sensors 101 and 102 are situated as shown in FIG. 4 with respect to the measurement target 106*a* which is integrally fixed to the stationary scroll retaining mechanism 106*b*. In this embodiment, the displacement sensors 101 are mounted at three different positions to measure the vertical displacements of the measurement target 106*a* at three different points thereof, whereas the displacement sensors 102 are mounted at two different positions to measure the horizontal displacements of the measurement target 106*a* at two different points thereof.

These displacement sensors 101, 102 make it possible to calculate displacements of contact points between a side surface of the scroll wrap 1*b* of the stationary scroll 1 and a side surface of the scroll wrap 2*b* of the orbiting scroll 2 even when the stationary scroll 1 inclines relative to the guide frame 15 during measurement.

One each pair of displacement sensors 116*a* and displacement sensors 116*b* shown in FIG. 3 together constitute means for measuring horizontal displacements and inclination of the shell 20. These pairs of displacement sensors 116*a*, 116*b* make it possible to measure the position of the stationary scroll 1 relative to the shell 20 even when the shell 20 moves during measurement for whatever reason.

In this embodiment, the displacement sensors 102 are arranged to measure the displacements of the measurement target 106*a* (thus the displacements of the stationary scroll retaining mechanism 106*b*) in two perpendicular horizontal directions as depicted in FIG. 4. Similarly, the displacement sensors 116*a* and 116*b* are arranged to measure the displacements of the shell 20 in two perpendicular horizontal directions.

Referring again to FIG. 3, a vertical pressing mechanism 111 mounted on the first platform 210 of the assembly framework 119 is means for vertically pressing the stationary scroll 1 against the guide frame 15 under specific pressure through the measurement target 106*a* and the stationary scroll retaining mechanism 106*b*. A cylinder 100 is a prime mover for actuating the vertical pressing mechanism 111.

Actuators 105*a* and back pressure mechanisms 105*b* are used for centering the stationary scroll 1 during assembly of the scroll-type fluid machine. In this embodiment, there is provided one each pair of the actuator 105*a* and the back pressure mechanism 105*b* in the x- and y-directions as shown in FIGS. 5B and 6B.

A stationary scroll fixing mechanism (bolt-tightening mechanism) 112 shown in FIG. 3 is a mechanism for fixing the stationary scroll 1 to the guide frame 15 by tightening the bolts 26.

The positioning system also includes a computer 120 for performing overall system control. The computer 120 incorporates a controller which takes in such data as measurement data obtained by the aforementioned displacement sensors 101, 102, 116*a*, 116*b*, the amount of the thrust exerted by the radial thrust mechanism 114*b*, vertical pressing force exerted by the vertical pressing mechanism 111, rotating speed of the rotary shaft driving motor 110 and rotating speed of the radial thrust mechanism driving motor 117, and then controls the thrust produced by the radial thrust mechanism 114*b*, the vertical pressing force produced by the vertical pressing mechanism 111, and the rotating speeds of the rotary shaft driving motor 110 and the radial thrust mechanism driving motor 117. The computer 120 also incorporates means for calculating displacements of the stationary scroll 1 from the measurement data obtained by the displacement sensors 101 and 102 and evaluating stability of an orbital path of the stationary scroll 1, as well as means for determining a fixed position of the stationary scroll 1 relative to the guide frame 15 based on the displacements of the stationary scroll retaining mechanism 106*b* if the orbital path of the stationary scroll 1 is judged to be stable.

The working of the positioning system of the first embodiment is now described. The semifinished assembly shown in FIG. 2 is prepared by a procedure described below. As illustrated in FIG. 2, the guide frame 15 and the stator 18 are initially fixed in the shell 20. The compliant frame 3 is assembled into the already fixed guide frame 15. After inserting the rotary shaft 4 into the rotary shaft bearing 3*c* formed in the compliant frame 3, the rotor 19 is fixedly mounted on the rotary shaft 4. Then, with the secondary shaft end bearing 21*a* formed in the sub-frame 21 fitted on the secondary shaft end portion 4*b* located at the lower part of the rotary shaft 4, the sub-frame 21 is fixed to the shell 20. The orbiting scroll 2 is placed on top of the compliant frame 3 with the Oldham coupling (not shown in FIG. 2) placed in between such that the eccentric shaft end bearing 2*c* formed in the orbiting scroll 2 is fitted on the eccentric shaft end portion 4*a* of the rotary shaft 4. Then, the stationary scroll 1 is assembled with the orbiting scroll 2 such that the scroll wrap 1*b* of the stationary scroll 1 meshes with the scroll wrap 2*b* of the orbiting scroll 2. Subsequently, the stationary scroll 1 is tentatively fixed to the guide frame 15 by tightening the bolts 26 halfway such that the stationary scroll 1 is allowed to move freely relative to the guide frame 15.

Figure 7:
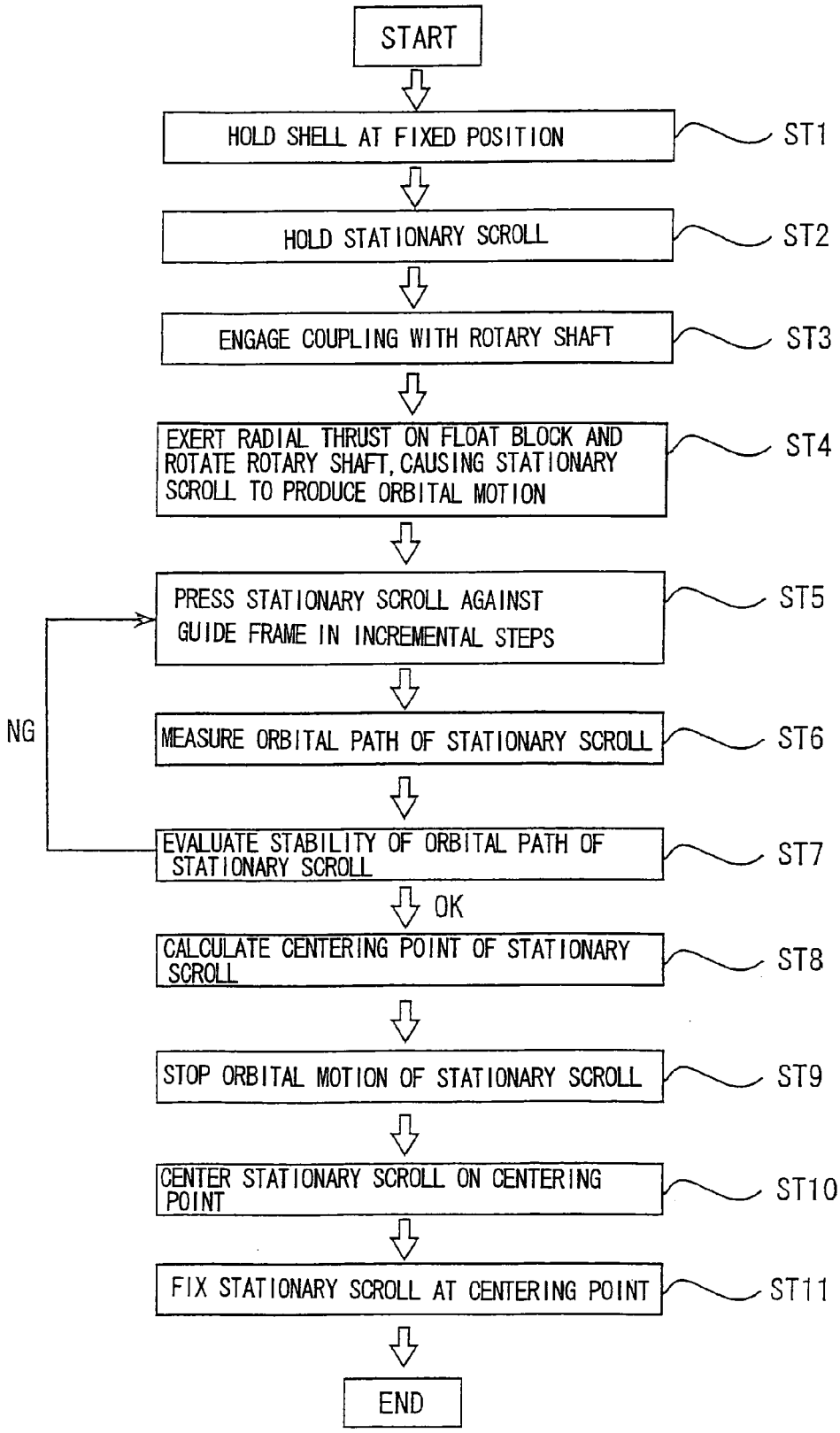
FIG. 7 is a flowchart showing a procedure for carrying out the positioning method applied to the scroll-type fluid machine according to the first embodiment of the invention.

Referring now to a flowchart of FIG. 7, a procedure for carrying out the positioning method applied to the scroll-type fluid machine according to the first embodiment is described.

First, the semifinished assembly shown in FIG. 2 is placed on the assembly framework 119 of the positioning system with the shell 20 of the assembly held at a fixed position on the assembly framework 119 by means of the work retaining mechanism 108 as shown in FIG. 3 in step 1 (ST1).

Next, the stationary scroll retaining mechanism 106*b* holds the tentatively fixed stationary scroll 1 in step 2 (ST2).

In succeeding step 3 (ST3), the cylinder 118 forces the movable platform 250 upward such that the coupling 109 is engaged with the rotary shaft 4.

In step 4 (ST4), the piston of the cylinder 114*a* for canceling out the radial thrust produced by the radial thrust mechanism 114*b* is retracted so that the radial thrust of the radial thrust mechanism 114*b* is exerted on the float block 113 in a radial direction (horizontal direction) as shown by arrow P in FIGS. 6B and 6C. Consequently, the float block 113 moves in the arrow direction in the xy-plane with the aid of the X-Y table 104 as shown in FIG. 6A. The measurement target 106*a* and the stationary scroll retaining mechanism 106*b* fixed to the float block 113 also move in the same horizontal direction together with the stationary scroll 1. Since the side surface of the scroll wrap 1*b* of the stationary scroll 1 is forced against the side surface of the scroll wrap 2*b* of the orbiting scroll 2 at this time, the rotary shaft 4 is caused to incline, by a specific angle from the vertical direction. In this embodiment, the direction of the radial thrust exerted by the radial thrust mechanism 114*b* on the float block 113 is controlled such that the direction of the radial thrust is opposed to a direction in which the eccentric shaft end portion 4*a* of the rotary shaft 4 is oriented. Then, the rotary shaft driving motor 110 and the radial thrust mechanism driving motor 117 are caused to turn at specific rotating speeds in synchronism with each other so that the stationary scroll 1 produces orbital motion.

In step 5 (ST5), the computer 120 causes the vertical pressing mechanism 111 to press the stationary scroll 1 against the guide frame 15 in incremental steps through the measurement target 106*a* and the stationary scroll retaining mechanism 106*b*.

In step 6 (ST6), the computer 120 measures at each successive pressing step a maximum horizontal displacement of the stationary scroll retaining mechanism 106*b*, and thus a maximum horizontal displacement of the stationary scroll 1, in all horizontal directions by using the displacement sensors 102. From the horizontal displacements thus measured, the computer 120 calculates an orbital path of the stationary scroll 1.

In step 7 (ST7), the computer 120 evaluates the stability of the orbital path of the stationary scroll 1 at each successive pressing step. More specifically, the computer 120 takes in data on the vertical pressing force exerted on the stationary scroll 1, the rotating speed of the rotary shaft driving motor 110 and data on the orbital motion of the stationary scroll 1 measured by the displacement sensors 102 and makes a judgment on the stability of the orbital path of the stationary scroll 1 based on these pieces of information.

Here, the orbital path of the stationary scroll 1 with good stability refers to a stable path which would be observed when the orbital motion of the stationary scroll 1 is not substantially affected by such disturbances as a compressive reaction caused by rotation of the rotary shaft 4 and friction between the Oldham guide grooves 2*e*, 3*b* and the Oldham coupling. Specifically, the orbital path having such stability is substantially a circular path with little distortion. When the orbital path of the stationary scroll 1 is a circular path, the stationary scroll 1 produces whirling motion with the side surfaces of the scroll wraps lb, 2*b* of the two scrolls 1, 2 held in continuous contact with each other in all rotational phases. The center of this circular orbital path is a point on which the stationary scroll 1 should be centered.

Figure 8:
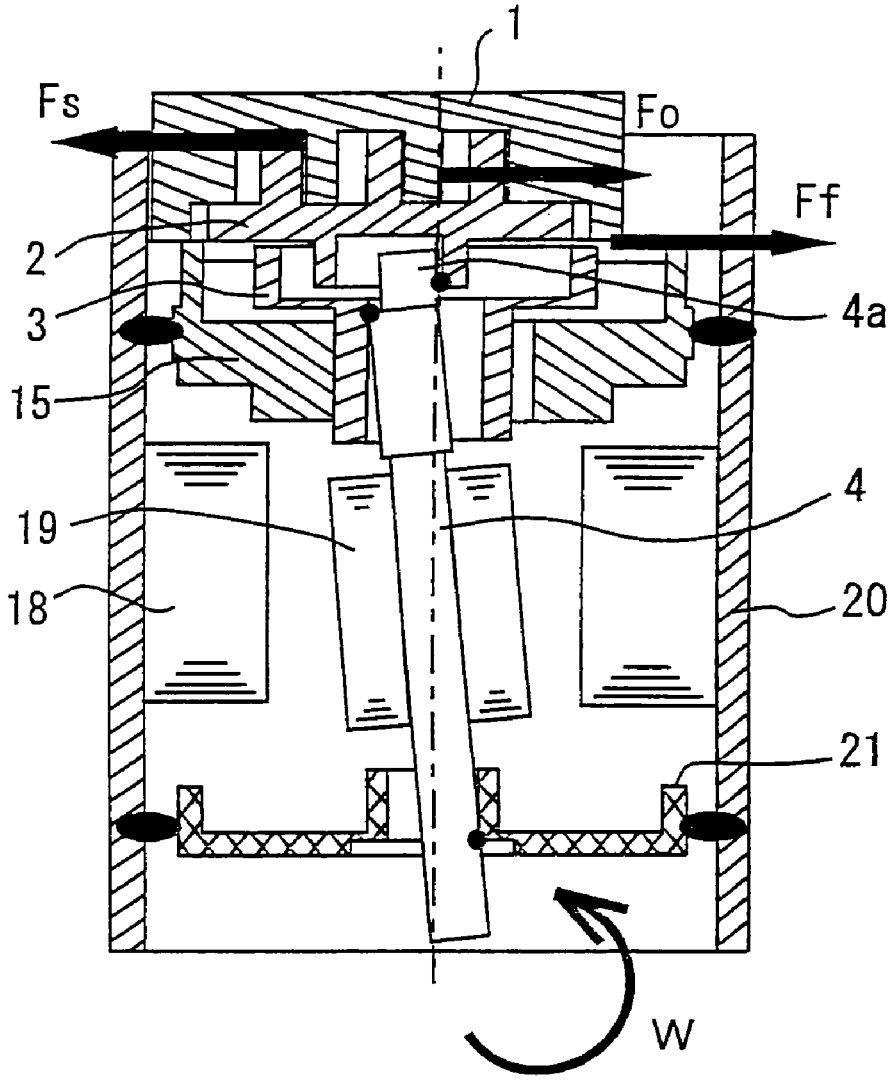
FIG. 8 is a cross-sectional diagram illustrating whirling motion produced by a stationary scroll according to the first embodiment of the invention.

If it is preferred to quickly obtain a desirable orbital path of the stationary scroll 1, the computer 120 may control the vertical pressing force exerted by the vertical pressing mechanism 111 for pressing the stationary scroll 1 against the guide frame 15, the rotating speed of the rotary shaft driving motor 110 and the rotating speed of the radial thrust mechanism driving motor 117 which is synchronized with the rotary shaft driving motor 110 in such a fashion that a condition expressed by equation (1) below would be satisfied:

$$F0 \ll Ff \leqq Fs \quad (1)$$

where F0 is a force caused by such disturbances as the aforementioned compressive reaction and friction acting on the stationary scroll 1, Ff is a frictional force occurring at contact points between the stationary scroll 1 and the guide frame 15, and Fs is a radial thrust exerted by the side surface of the scroll wrap 2*b* of the orbiting scroll 2 upon the side surface of the scroll wrap 1*b* of the stationary scroll 1, as shown in FIG. 8. The compressive reaction acting on the stationary scroll 1 is a force which varies with rotating speed w of the rotary shaft 4. Generally, the higher the rotating speed w of the rotary shaft 4, the larger the compressive reaction acting on the stationary scroll 1.

The frictional force Ff occurring between the stationary scroll 1 and the guide frame 15 and the compressive reaction acting on the stationary scroll 1 can be regulated by controlling the vertical pressing force exerted on the stationary scroll 1 against the guide frame 15, the rotating speed w of the rotary shaft 4 and rotational phase of the radial thrust Fs exerted on the stationary scroll 1. It is therefore possible to obtain a more desirable orbital path of the stationary scroll 1 in the aforementioned manner.

If the orbital path of the stationary scroll 1 is judged stable, that is, if the orbital path of the stationary scroll 1 calculated from the measurement data is verified to be a circular path in step 7 (ST7), the computer 120 calculates the position of the center of the circular orbital path and stores this position as a centering point (or fixing point) on which the stationary scroll 1 should be fixedly centered with respect to the guide frame 15 in step 8 (ST8).

In step 9 (ST9), the computer 120 deactivates the rotary shaft driving motor 110 and the radial thrust mechanism driving motor 117 so that the stationary scroll 1 stops orbiting. Then, the computer 120 causes the piston of the cylinder 114*a* to extend so that the radial thrust mechanism 114*b* is retracted as shown in FIGS. 5B and 5C.

In succeeding step 10 (ST10), the computer 120 centers the stationary scroll 1 on the centering point obtained in step 8 (ST8) above with respect to the guide frame 15 by operating the actuators 105*a* and the back pressure mechanisms 105*b* while adjusting the vertical pressing force exerted on the stationary scroll 1.

Finally, in step 11 (ST11), the computer 120 activates the stationary scroll fixing mechanism 112 to fix the stationary scroll 1 to the guide frame 15 at the centering point by tightening the bolts 26.

Now, the central position of the orbital path of the stationary scroll 1 determined when a desirable orbital path is obtained as a result of measurements in step 6 (ST6) is explained. FIG. 8 is a cross-sectional diagram showing a condition in which the scroll wraps 1*b*, 2*b* of the two scrolls 1, 2 are intermeshed at a rotational phase of 0 degrees or 180 degrees. It is to be noted that the rotary shaft 4 is inclined in a direction opposite to a direction shown in FIG. 8 when the rotational phase is 180 degrees. The radial thrust exerted by the radial thrust mechanism 114*b* causes the stationary scroll 1 to produce the whirling motion in such a fashion that the rotary shaft 4 is inclined in a direction opposite to the direction in which the eccentric shaft end portion 4*a* of the rotary shaft 4 is oriented and the side surfaces of the scroll wraps 1*b*, 2*b* of the two scrolls 1, 2 are held in continuous contact with each other in all rotational phases as illustrated in FIG. 8. Small black dots in FIG. 8 represent contact points. It is possible to determine the central position of the orbital path of the stationary scroll 1 by measuring the position of the stationary scroll 1 in relation to the shell 20.

According to the first embodiment, it is possible to automatically position the stationary scroll 1 with high precision from the condition in which the scroll wraps 1*b*, 2*b* of the stationary scroll 1 and the orbiting scroll 2 are intermeshed regardless of accuracy of machining the scroll wraps 1*b*, 2*b* of the two scrolls 1, 2 and other elements and then assemble the scroll-type fluid machine.

Also, the foregoing first embodiment makes it possible to automatically position the stationary scroll 1 with high precision from the condition in which the scroll wraps 1*b*, 2*b* of the two scrolls 1, 2 are intermeshed even if the compliant frame 3 having the rotary shaft bearing 3*c*, the guide frame 15 and the sub-frame 21 having the secondary shaft end bearing 21*a* are already fixed to the shell 20 of the scroll-type fluid machine.

Second Embodiment

Figure 9:
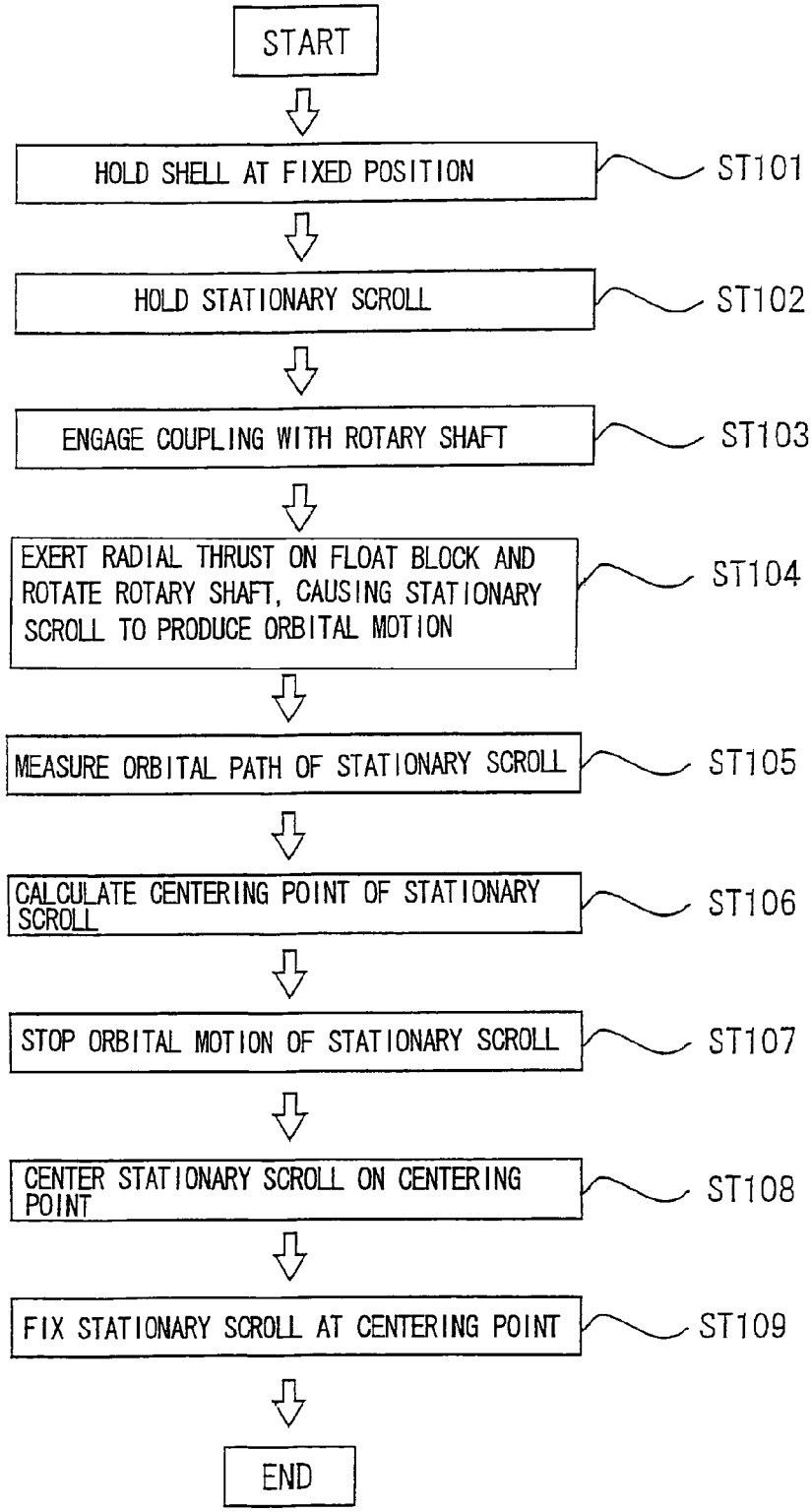
FIG. 9 is a flowchart showing a procedure for carrying out a positioning method applied to a scroll-type fluid machine according to a second embodiment of the invention.

FIG. 9 is a flowchart showing a procedure for carrying out a positioning method applied to a scroll-type fluid machine according to a second embodiment of the invention. The positioning method and the assembly method of the second embodiment described below are for assembling the same semifinished assembly of the scroll-type fluid machine by using the same positioning system as described in the aforementioned first embodiment shown in FIGS. 2 and 3.

The positioning method of the second embodiment are now described with reference to the flowchart of FIG. 9.

First, the semifinished assembly shown in FIG. 2 is placed on the assembly framework 119 of the positioning system with the shell 20 of the assembly held at a fixed position on the assembly framework 119 by means of the work retaining mechanism 108 as shown in FIG. 3 in step 101 (ST101).

Next, the stationary scroll retaining mechanism 106*b* holds the tentatively fixed stationary scroll 1 in step 102 (ST102).

In succeeding step 103 (ST103), the cylinder 118 forces the movable platform 250 upward such that the coupling 109 is engaged with the rotary shaft 4.

Figure 10:
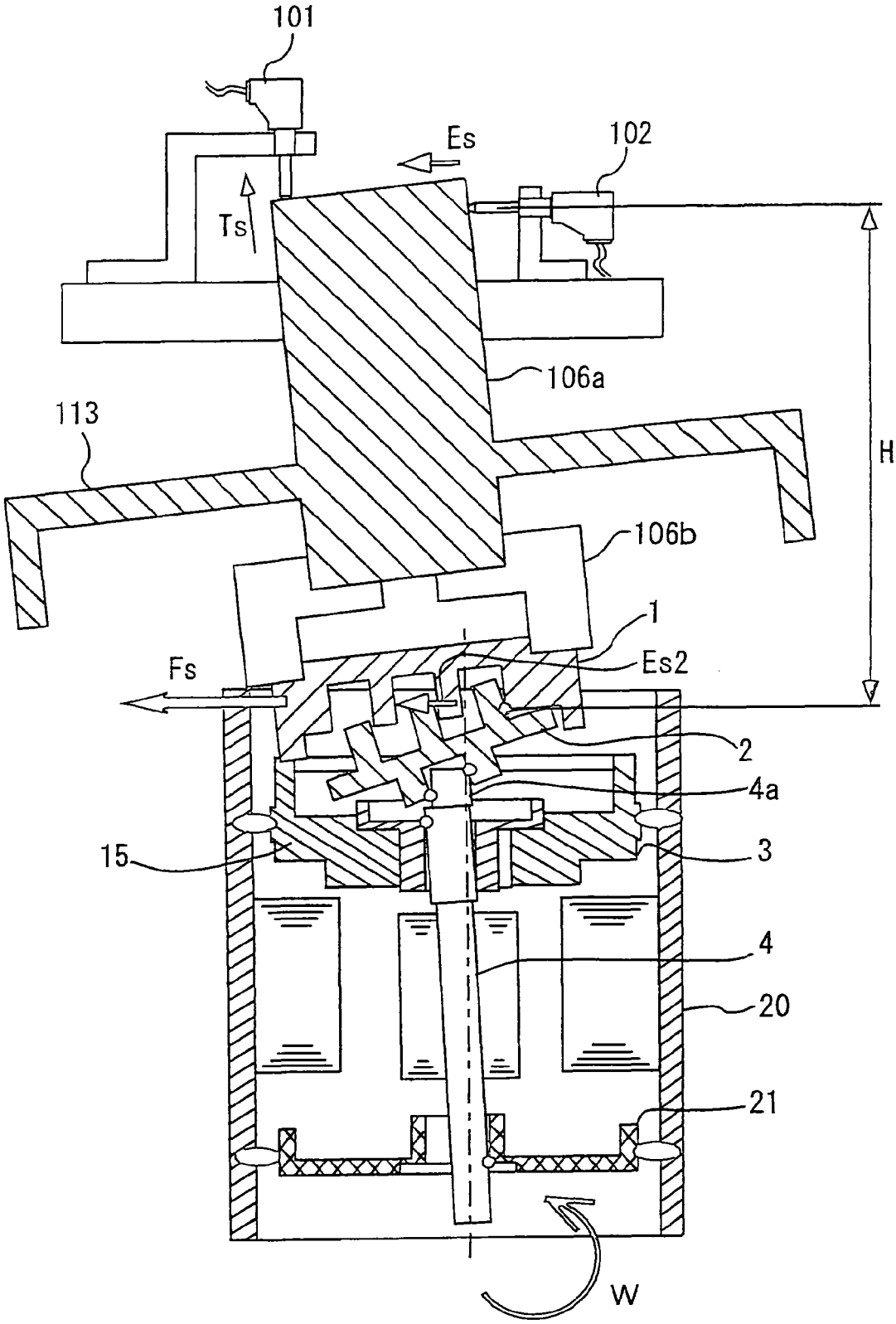
FIG. 10 is a cross-sectional diagram illustrating whirling motion produced by the stationary scroll according to the second embodiment of the invention.

In step 104 (ST104), the piston of the cylinder 114*a* for canceling out the radial thrust produced by the radial thrust mechanism 114*b* is retracted so that the radial thrust of the radial thrust mechanism 114*b* is exerted on the float block 113 in the radial direction (horizontal direction) as shown by the arrow P in FIGS. 6B and 6C. Consequently, the float block 113 moves in the arrow direction in the xy-plane with the aid of the X-Y table 104 as shown in FIG. 6A. The measurement target 106*a* and the stationary scroll retaining mechanism 106*b* fixed to the float block 113 also move in the same horizontal direction together with the stationary scroll 1. Since the stationary scroll 1 also moves in the horizontal direction at this time, the rotary shaft 4 is caused to incline by a specific angle from the vertical direction. FIG. 10 is a schematic diagram showing how the rotary shaft 4 and associated elements thereof are inclined. The direction of the radial thrust exerted by the radial thrust mechanism 114*b* on the float block 113 is controlled such that the direction of the radial thrust is opposed to the direction in which the eccentric shaft end portion 4*a* of the rotary shaft 4 is oriented. Then, the rotary shaft driving motor 110 and the radial thrust mechanism driving motor 117 are caused to turn in synchronism with each other so that the stationary scroll 1 produces orbital motion.

Figure 11A:
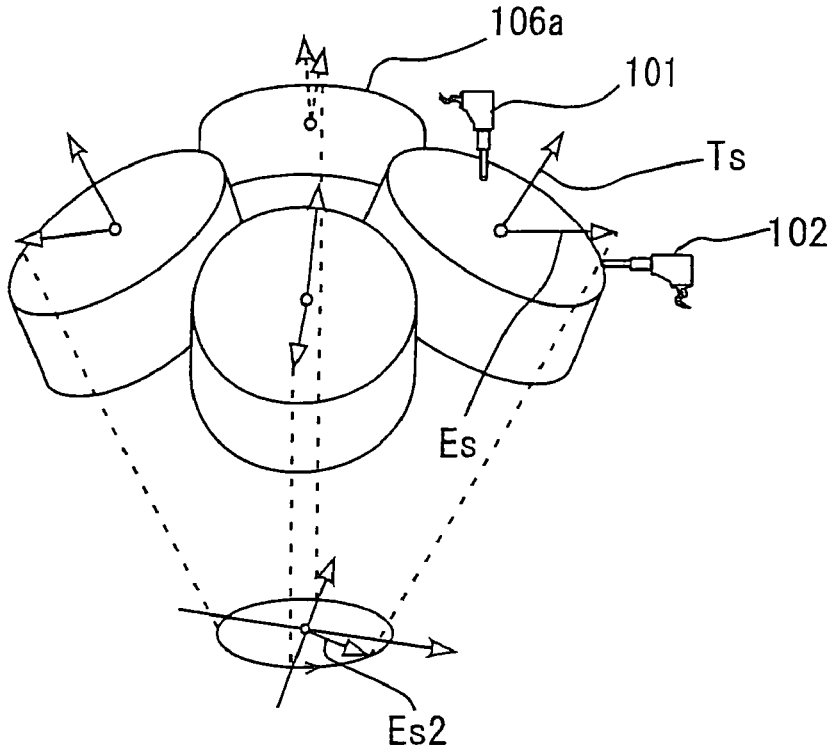
FIGS. 11A and 11B are diagrams showing respectively orbital motion and orbital path produced by the stationary scroll at a point where scroll wraps of two scrolls are held in contact with each other in the scroll-type fluid machine according to the second embodiment.

In step 105 (ST105), the computer 120 measures inclination and horizontal displacement of the measurement target 106*a* which is fixed to the stationary scroll retaining mechanism 106*b*, that is, inclination Ts (vector quantity) and horizontal displacement Es (vector quantity) of the stationary scroll 1, in all horizontal directions by using the displacement sensors 101 and 102 as shown in FIG. 11A. From the inclinations and horizontal displacements thus measured, the computer 120 calculates an orbital path of the stationary scroll 1.

Here, the orbital path (vector quantity) Es2 produced by the stationary scroll 1 at a point where the scroll wraps 1*b*, 2*b* of the two scrolls 1, 2 are held in contact with each other (that is, a bottom point of the scroll wrap 1*b* of the stationary scroll 1) as shown in FIG. 10 is calculated by equation (2) below:

$$Es2=Es+H\times Ts \quad (2)$$

Referring to FIG. 10, Es2 indicates the horizontal displacement (vector quantity) of the stationary scroll 1 obtained at the point (wrap contact point) where the scroll wraps 1*b*, 2*b* of the two scrolls 1, 2 are in contact, and H indicates the vertical distance from the displacement sensors 102 to the wrap contact point. In this embodiment, the elastic suspending force produced by the suspension springs 103*a* of the suspension mechanism 103 is preadjusted such that a sufficient clearance is created between the stationary scroll 1 and the guide frame 15 when the stationary scroll 1 produces the orbital motion.

Figure 11B:
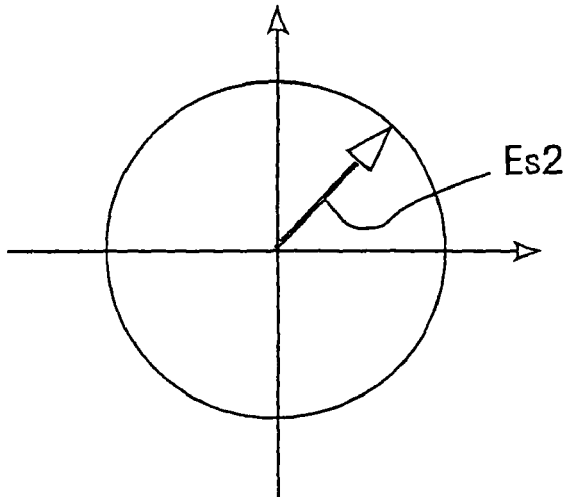

If the orbital path of the stationary scroll 1 is judged to be desirable, that is, if a circular path with little distortion as shown in FIG. 11B is obtained, the computer 120 calculates from the orbital path Est (vector quantity) a centering point (or fixing point) on which the stationary scroll 1 should be fixedly centered with respect to the guide frame 15 in step 106 (ST106).

In step 107 (ST107), the computer 120 deactivates the rotary shaft driving motor 110 and the radial thrust mechanism driving motor 117 so that the stationary scroll 1 stops orbiting. Then, the computer 120 causes the piston of the cylinder 114*a* to extend so that the radial thrust mechanism 114*b* is retracted as shown in FIGS. 5B and 5C.

In succeeding step 108 (ST108), the computer 120 centers the stationary scroll 1 on the centering point obtained in step 106 (ST106) above with respect to the guide frame 15 by operating the actuators 105*a* and the back pressure mechanisms 105*b* while adjusting the vertical pressing force exerted on the stationary scroll 1.

Finally, in step 109 (ST109), the computer 120 activates the stationary scroll fixing mechanism 112 to fix the stationary scroll 1 to the guide frame 15 at the centering point by tightening the bolts 26.

According to the second embodiment, there is created a sufficient clearance between the stationary scroll 1 and the guide frame 15 as stated above, so that the orbital motion of the stationary scroll 1 is not affected by such disturbances as the compressive reaction caused by rotation of the rotary shaft 4 and the friction between the Oldham guide grooves 2*e*, 3*b* and the Oldham coupling. Therefore, if the radial thrust exerted by the radial thrust mechanism 114*b* and the elastic suspending force produced by the suspension springs 103*a* are properly preadjusted, it is possible to obtain a stable orbital path of the stationary scroll 1 even in the absence of the vertical pressing force exerted by the vertical pressing mechanism 111 which is required in the first embodiment.

Additionally, since the stationary scroll 1 is free from the influence of the compressive reaction which normally increases with an increase in the rotating speed w of the stationary scroll 1, the orbital motion of the stationary scroll 1 is unaffected by the inclination of the rotary shaft 4 and other internal elements of the scroll-type fluid machine. It is therefore possible to operate the positioning system by turning the rotary shaft 4 at an increased rotating speed up to a point where internal mechanisms of the scroll-type fluid machine reach stable running conditions. This feature of the second embodiment offers an advantage of reducing measurement time.

Third Embodiment

Figure 12:
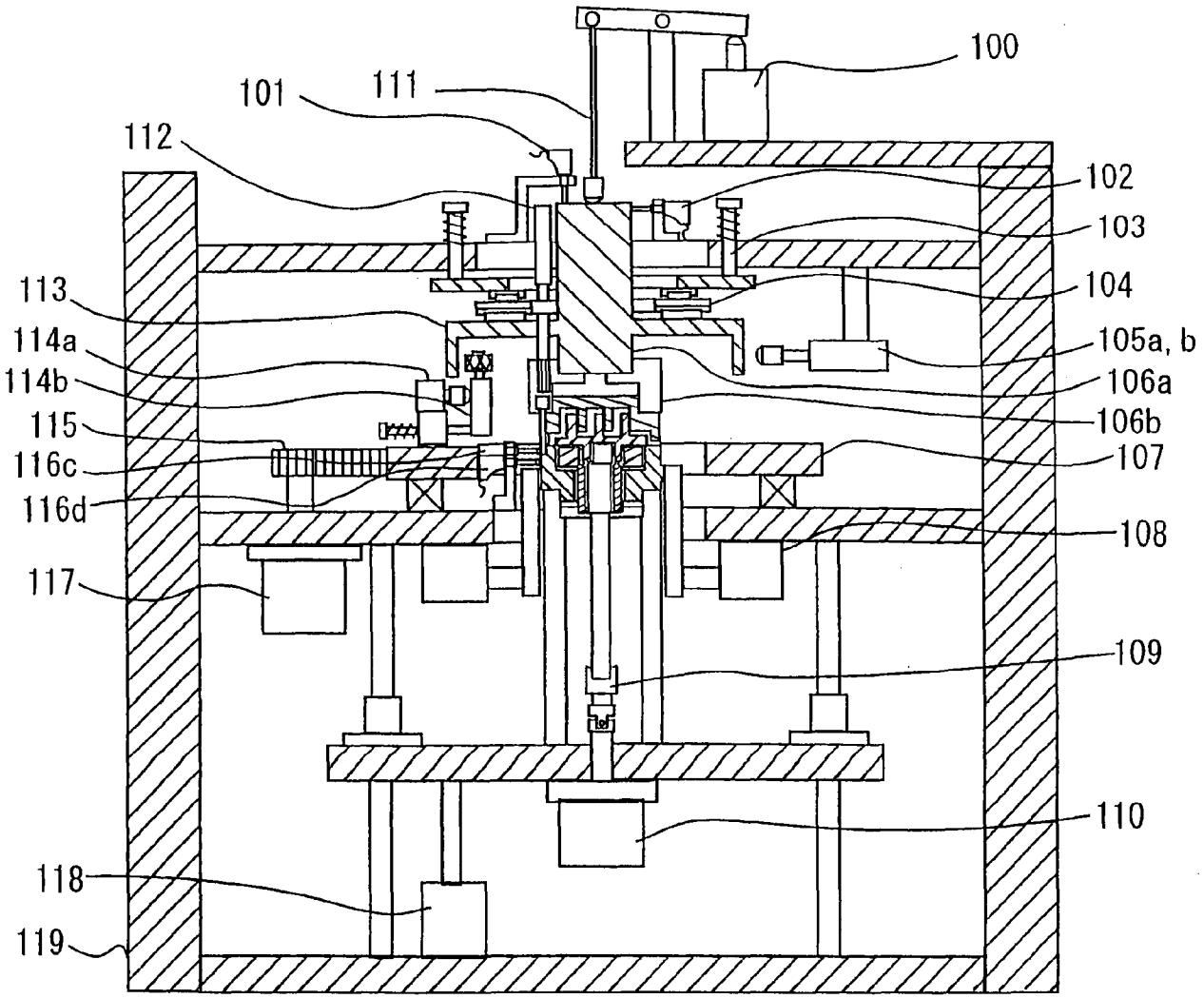
FIG. 12 is a diagram generally showing the construction of a positioning system used during assembly of a scroll-type fluid machine according to a third embodiment of the invention.

Now, a positioning method and an assembly method applied to a positioning system used during assembly of a scroll-type fluid machine according to a third embodiment of the invention are described. FIG. 12 is a diagram generally showing the construction of the positioning system according to the third embodiment of the invention.

Compared to the assembly described in the foregoing first and second embodiments, a unit (or semifinished assembly) to be assembled by the positioning method and the assembly method of the third embodiment is characterized in that neither the sub-frame 21 nor the guide frame 15 is fixed to the shell 20 and the rotor 19 is not mounted on the rotary shaft 4. In this embodiment, the semifinished assembly is prepared as follows. Specifically, after assembling the compliant frame 3 into the guide frame 15 and inserting the rotary shaft 4 into the rotary shaft bearing 3*c* formed in the compliant frame 3, the orbiting scroll 2 is placed on top of the compliant frame 3 with the Oldham coupling (not shown in FIG. 12) placed in between such that the eccentric shaft end bearing 2*c* formed in the orbiting scroll 2 is fitted on the eccentric shaft end portion 4*a* of the rotary shaft 4. Then, the stationary scroll 1 is assembled with the orbiting scroll 2 such that the scroll wrap 1*b* of the stationary scroll 1 meshes with the scroll wrap 2*b* of the orbiting scroll 2. Subsequently, the stationary scroll 1 is tentatively fixed to the guide frame 15 by tightening the bolts 26 halfway such that the stationary scroll 1 is allowed to move freely relative to the guide frame 15. The positioning method of the third embodiment applies to a process of positioning the stationary scroll 1 and fixing the same to the guide frame 15 in the semifinished assembly prepared as described above.

Constructed as shown FIG. 12, the positioning system of the third embodiment has the same construction as that of the first and second embodiments except that:

(1) The positioning system includes upper frame displacement sensors 116*c* and lower frame displacement sensors 116*d* instead of the displacement sensors 101, 102 of the positioning system of the first embodiment. The upper and lower displacement sensors 116*c*, 116*d* are for measuring displacements of the guide frame 15 at two vertically separated positions from at least two horizontal directions; and (2) The work retaining mechanism 108 directly holds the guide frame 15.

The positioning method and the assembly method applied to the scroll-type fluid machine according to the third embodiment are carried out by a procedure similar to the procedures of the first and second embodiments shown in the flowcharts of FIGS. 7 and 9.

It is appreciated from the above discussion that the invention can be applied to the assembly in which neither the sub-frame 21 nor the guide frame 15 is fixed to the shell 20 by carrying out the positioning method and the assembly method of the third embodiment in accordance with the procedure similar to the procedures of the first and second embodiments. More specifically, the present embodiment makes it possible to automatically position the stationary scroll 1 with high precision from a condition in which the scroll wraps 1*b*, 2*b* of the stationary scroll 1 and the orbiting scroll 2 are intermeshed regardless of accuracy of machining the scroll wraps 1*b*, 2*b* of the two scrolls 1, 2 and other elements and then assemble the scroll-type fluid machine.

Fourth Embodiment

Figure 13:
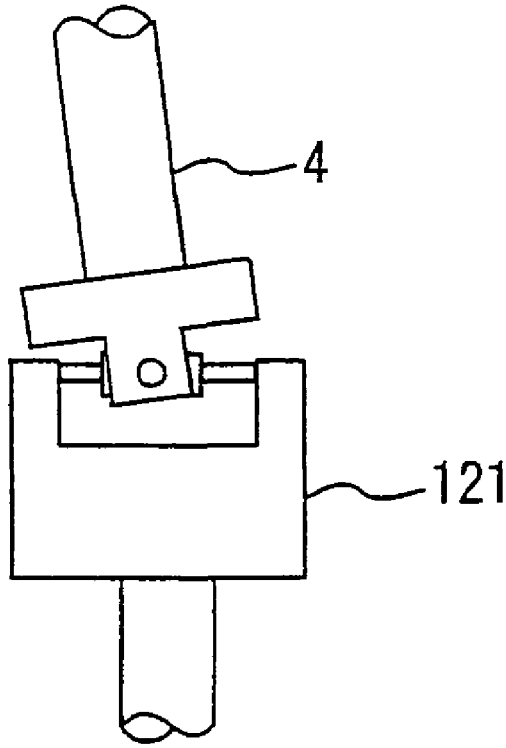
FIG. 13 is a diagram showing the structure of a coupling which serves as means for transmitting a torque in a positioning system according to a fourth embodiment of the invention.

FIG. 13 is a diagram showing the structure of a coupling 121 which serves as means for transmitting a torque in a positioning system used during assembly of a scroll-type fluid machine according to a fourth embodiment of the invention. The positioning system has otherwise the same construction as that of the foregoing embodiments and, thus, a detailed of the positioning system is not provided here.

The coupling 121 of FIG. 13 is an Oldham coupling used as means for transmitting the torque produced by the rotary shaft driving motor 110 to the rotary shaft 4. The Oldham coupling 121, if used, allows the rotary shaft 4 to freely produce whirling motion, because the rotary shaft 4 is not acted upon by a force which causes an axis of the rotary shaft 4 to align with an axis of the drive shaft of the rotary shaft driving motor 110 regardless of whether the axis of the rotary shaft 4 is offset from the axis of the drive shaft of the rotary shaft driving motor 110.

Figure 14A:
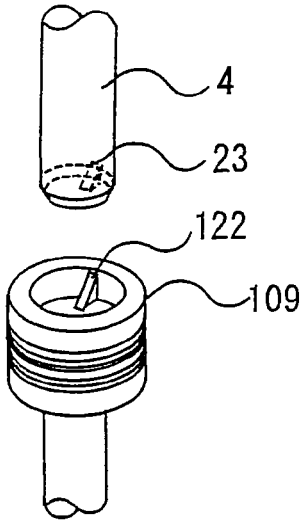
FIG. 14 is a diagram showing the structure of another coupling which serves as means for transmitting a torque in a positioning system according to the fourth embodiment of the invention.
Figure 14B:
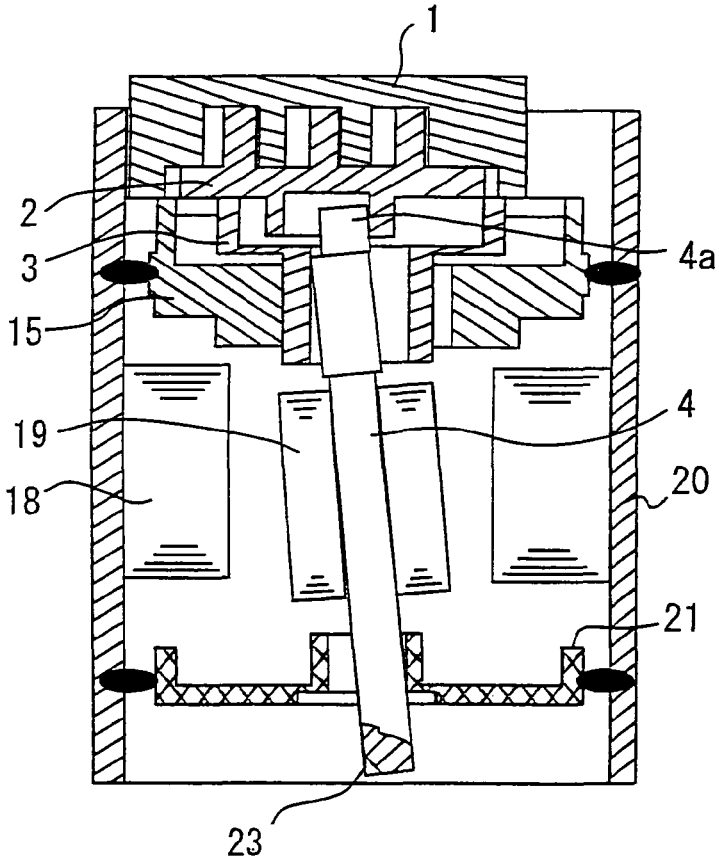

Alternatively, there may be formed a groove 23 at an end of the rotary shaft 4 opposite to the eccentric shaft end portion 4*a* and a claw 122 inside the coupling 109 provided on the drive shaft of the rotary shaft driving motor 110 as illustrated in FIGS. 14A and 14B taking into consideration the rotational phase of the eccentric shaft end portion 4*a* of the rotary shaft 4. It is possible to construct the scroll-type fluid machine in such a manner that the rotary shaft 4 is always held in contact with the rotary shaft bearing 3*c* in the direction in which the eccentric shaft end portion 4*a* of the rotary shaft 4 is oriented when the coupling 109 is joined to the rotary shaft 4 with the claw 122 fitted in the groove 23.

Fifth Embodiment

Now, a positioning method and an assembly method applied to a positioning system used during assembly of a scroll-type fluid machine according to a fifth embodiment of the invention are described.

In steps 6 (ST6) and 7 (ST7), and step 105 (ST105), described in the aforementioned first and second embodiments, the computer 120 evaluates the stability of the orbital path of the stationary scroll 1 by measuring displacements of the stationary scroll retaining mechanism 106*b* with the displacement sensors 102 (displacement sensors 101, 102 in the second embodiment), calculating the orbital path of the stationary scroll 1 and judging whether the orbital path is a circular path.

Figure 15:
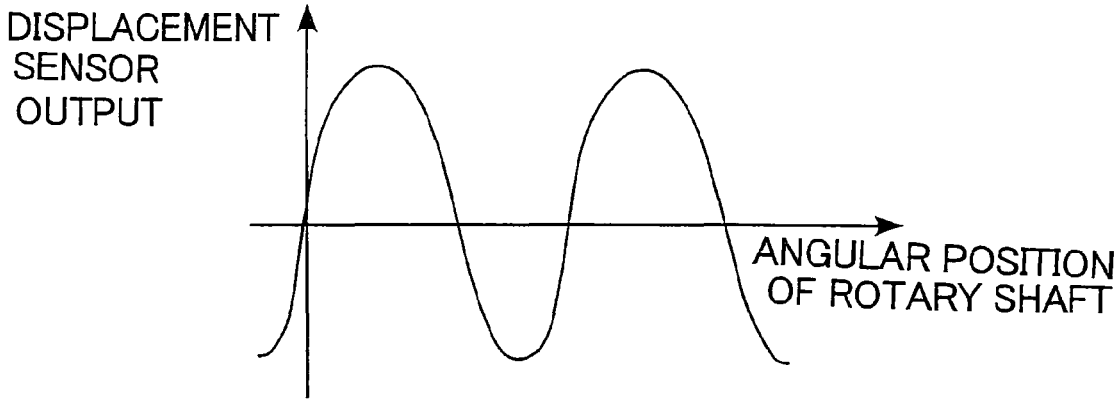
FIG. 15 is a diagram showing the amplitude and period of displacements of the stationary scroll measured by a positioning system according to a fifth embodiment of the invention when a stable orbital path of the stationary scroll is obtained.
Figure 16:
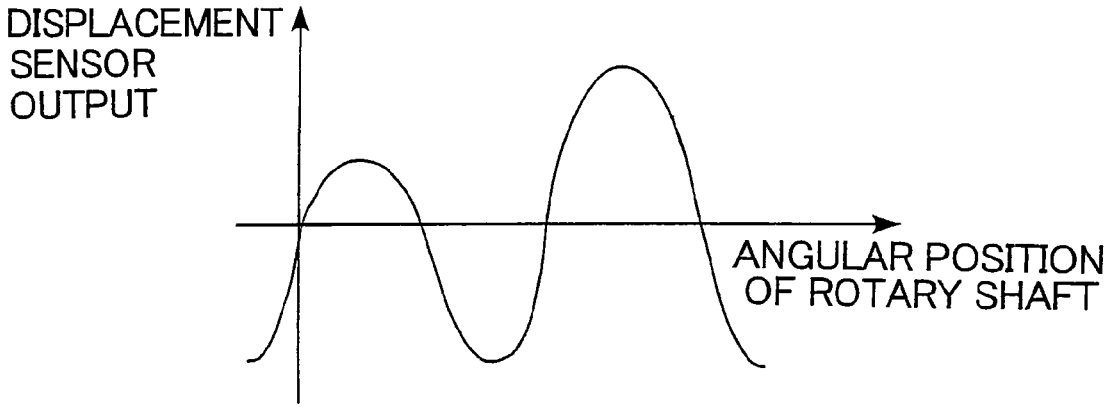
FIG. 16 is a diagram showing the amplitude and period of displacements of the stationary scroll measured by the positioning system of the fifth embodiment when the orbital path of the stationary scroll is unstable.

In a process of orbital path evaluation, the fifth embodiment utilizes the fact that the displacements of the stationary scroll 1 measured by the displacement sensors 102 have a constant amplitude and vary at regular time intervals as shown in FIG. 15 when a stable orbital path of the stationary scroll 1 is obtained. Generally, an average value of the displacements measured by each displacement sensor 102 represents a deviation from the centering point of the stationary scroll 1 in a direction in which that displacement sensor 102 is oriented. In this embodiment, the positioning system is configured to measure displacements of the stationary scroll 1 from at least two directions by using a plurality of displacement sensors 102, observe the amplitude and period of the measured displacements and make a judgment on the stability of the orbital path of the stationary scroll 1. If the amplitude and period of the displacements measured by the displacement sensors 102 vary as shown in FIG. 16, the orbital path of the stationary scroll 1 is judged to be unstable.

Variations of the Embodiments

While the displacement sensors 102 are arranged to measure the displacements of the measurement target 106*a* in two perpendicular horizontal directions as shown in FIG. 4 to determine the location of the stationary scroll 1 in the foregoing embodiments, the invention is not limited to this arrangement. For example, the positioning system may be modified such that the displacement sensors 102 directly measure the displacements of the stationary scroll retaining mechanism 106*b* or the stationary scroll 1. Also, the displacement sensors 102 need not necessarily measure the displacements from two perpendicular horizontal directions, but may measure the displacements from at least two directions which need not necessarily be perpendicular to each other if the directions of measurement are unambiguously defined.

While the displacement sensors 101 are arranged to measure the vertical displacements of the measurement target 106*a* at three different points angularly separated from one another by 120 degrees as shown in FIG. 4 to determine the inclination of the stationary scroll retaining mechanism 106*b*, the invention is not limited to this arrangement. For example, the positioning system may be modified such that the displacement sensors 101 directly measure the vertical displacements of the stationary scroll retaining mechanism 106*b* or the stationary scroll 1. Also, the displacement sensors 101 need not necessarily measure the vertical displacements at the three different points angularly separated from one another by 120 degrees, but may measure the vertical displacements at least at three different points if the points of measurement are unambiguously defined.

While the displacement sensors 116*a* and 116*b* measure horizontal displacements of the shell 20 on an cylindrical outer surface thereof as shown in FIG. 3 in the foregoing embodiments, the invention is not limited to this arrangement. For example, the positioning system may be modified such that the displacement sensors 116*a* and 116*b* measure the horizontal displacements of the shell 20 on a cylindrical inner surface thereof at locations lower than the sub-frame 21.

While the pair of displacement sensors 116*a* and the pair of displacement sensors 116*b* are provided at upper and lower positions as shown in FIG. 3 to determine inclination of the shell 20 in the foregoing embodiments, the invention is not limited to this arrangement. For example, these displacement sensors 116*a*, 116*b* may be configured to determine inclination of a bottom surface of the sub-frame 21.

Furthermore, while the displacement sensors 101, 102, 116*a*, 116*b* (and the displacement sensors 116*c*, 116*d* instead of the displacement sensors 116*a*, 116*b*) employed in the foregoing embodiments are contact-type displacement sensors, noncontact displacement sensors such as eddy current displacement sensors may be used instead. The noncontact displacement sensors, if employed, do not interfere with movements of measured areas by applying thrust or friction forces caused by direct contact, so that the noncontact displacement sensors can measure displacements of the measured areas with higher precision than the contact-type displacement sensors.

While the invention has thus far been described with reference to the preferred embodiments applied to the scroll-type fluid machine in which the compliant frame 3 is fitted in the guide frame 15 as shown in FIGS. 1 and 2, the invention is also applicable to other types of scroll-type fluid machines such as a scroll-type fluid machine provided with no compliant frame 3. As an example, the invention is applicable to a scroll-type fluid machine provided with a frame in which the compliant frame 3 and the guide frame 15 are together formed in a single structure, the frame having a rotary shaft bearing inside.

What is claimed is:

1. A positioning system used in a process of assembling a scroll-type fluid machine from a semifinished assembly which has been prepared by fixing a frame in a shell, inserting a rotary shaft into a rotary shaft bearing provided in said frame, inserting a secondary shaft end portion of said rotary shaft into a secondary shaft end bearing provided in a sub-frame, fixing said sub-frame in said shell, assembling an orbiting scroll with said frame with an Oldham coupling placed in between such that an eccentric shaft end portion formed at one end of said rotary shaft is fitted in an eccentric shaft end bearing provided in said orbiting scroll, assembling a stationary scroll with said orbiting scroll such that a scroll wrap of said stationary scroll meshes with a scroll wrap of said orbiting scroll, and tentatively fixing said stationary scroll to said frame in such a manner that said stationary scroll is allowed to move freely relative to said frame, said positioning system comprising:

a work retaining mechanism for holding said shell of said semifinished assembly;

a stationary scroll retaining mechanism for holding said stationary scroll in such a manner that said stationary scroll can move both horizontally and vertically;

a rotary shaft driving motor for turning said rotary shaft;

a radial thrust mechanism for exerting a horizontal thrust on said stationary scroll retaining mechanism;

a radial thrust mechanism driving motor for turning said radial thrust mechanism in synchronism with rotational phase of said rotary shaft;

a vertical pressing mechanism for producing a vertical pressing force for pressing said stationary scroll against said frame;

a displacement sensor for measuring horizontal displacements of said stationary scroll retaining mechanism from at least two directions;

a first processor for calculating an orbital path of said stationary scroll from measurement values obtained by said displacement sensor;

a second processor for evaluating stability of the orbital path of said stationary scroll based on data on the vertical pressing force and the orbital path of said stationary scroll; and a third processor for calculating a fixing point on which said stationary scroll is to be fixedly centered with respect to said frame when the orbital path of said stationary scroll is judged to be stable.

2. A positioning system used in a process of assembling a scroll-type fluid machine from a semifinished assembly which has been prepared by fixing a frame in a shell, inserting a rotary shaft into a rotary shaft bearing provided in said frame, inserting a secondary shaft end portion of said rotary shaft into a secondary shaft end bearing provided in a sub-frame, fixing said sub-frame in said shell, assembling an orbiting scroll with said frame with an Oldham coupling placed in between such that an eccentric shaft end portion formed at one end of said rotary shaft is fitted in an eccentric shaft end bearing provided in said orbiting scroll, assembling a stationary scroll with said orbiting scroll such that a scroll wrap of said stationary scroll meshes with a scroll wrap of said orbiting scroll, and tentatively fixing said stationary scroll to said frame in such a manner that said stationary scroll is allowed to move freely relative to said frame, said positioning system comprising:

a work retaining mechanism for holding said shell of said semifinished assembly;

a stationary scroll retaining mechanism for holding said stationary scroll in such a manner that said stationary scroll can move both horizontally and vertically;

a rotary shaft driving motor for turning said rotary shaft;

a radial thrust mechanism for exerting a horizontal thrust on said stationary scroll retaining mechanism;

a radial thrust mechanism driving motor for turning said radial thrust mechanism in synchronism with rotational phase of said rotary shaft;

a mechanism for creating a clearance between said stationary scroll and said frame;

a displacement sensor for measuring horizontal displacements of said stationary scroll retaining mechanism from at least two directions;

an inclination sensor for measuring inclination of said stationary scroll retaining mechanism;

a first processor for calculating an orbital path of said stationary scroll formed by a contact point of the scroll wrap of said stationary scroll and the scroll wrap of said orbiting scroll from measurement values of the horizontal position and inclination of said stationary scroll retaining mechanism;

a second processor for evaluating stability of the orbital path of said stationary scroll calculated by said first processor; and a third processor for calculating a fixing point on which said stationary scroll is to be fixedly centered with respect to said frame when the orbital path of said stationary scroll is judged to be stable.

3. The positioning system used in the process of assembling the scroll-type fluid machine according to claim 1, wherein said rotary shaft driving motor is connected to said rotary shaft via an Oldham coupling.

4. The positioning system used in the process of assembling the scroll-type fluid machine according to claim 1, said positioning system further comprising a shell position sensor for measuring the position and inclination of said shell with respect to a main portion of said positioning system.

5. The positioning system used in the process of assembling the scroll-type fluid machine according to claim 1, said positioning system further comprising a stationary scroll fixing mechanism for fixing said stationary scroll at the fixing point determined by said third processor with respect to said frame.

* * * * *